US011092308B2

(12) United States Patent
Matsumoto et al.

(10) Patent No.: US 11,092,308 B2
(45) Date of Patent: Aug. 17, 2021

(54) VEHICLE HEADLAMP

(71) Applicant: KOITO MANUFACTURING CO., LTD., Tokyo (JP)

(72) Inventors: Akinori Matsumoto, Shizuoka (JP); Kazuma Mochizuki, Shizuoka (JP); Yoshiyuki Nakanishi, Shizuoka (JP); Teppei Muramatsu, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 16/334,449

(22) PCT Filed: Sep. 15, 2017

(86) PCT No.: PCT/JP2017/033535
§ 371 (c)(1),
(2) Date: Mar. 19, 2019

(87) PCT Pub. No.: WO2018/056218
PCT Pub. Date: Mar. 29, 2018

(65) Prior Publication Data

US 2019/0211990 A1 Jul. 11, 2019

(30) Foreign Application Priority Data

Sep. 21, 2016 (JP) ..... JP2016-184100

(51) Int. Cl.
*F21V 17/02* (2006.01)
*F21S 41/689* (2018.01)
(Continued)

(52) U.S. Cl.
CPC ..... *F21S 41/689* (2018.01); *F21S 41/00* (2018.01); *F21S 41/365* (2018.01);
(Continued)

(58) Field of Classification Search
CPC ..... F21S 41/675; F21S 41/689; F21S 41/365; F21S 41/36; F21W 2102/18
See application file for complete search history.

(56) References Cited

U.S. PATENT DOCUMENTS 6,543,910 B2 * 4/2003 Taniuchi ..... F21S 41/162 362/297
8,506,146 B2 8/2013 Kinoshita et al.
(Continued)

FOREIGN PATENT DOCUMENTS

CN 201131631 Y 10/2008
JP 60-164478 U 10/1985
(Continued)

OTHER PUBLICATIONS

International Search Report dated Nov. 21, 2017 by the International Searching Authority in counterpart International Patent Application No. PCT/JP2017/033535. (PCT/ISA/210).
(Continued)

*Primary Examiner* — William J Carter
*Assistant Examiner* — Omar Rojas Cadima
(74) *Attorney, Agent, or Firm* — Sughrue Mion, PLLC

(57) ABSTRACT

A light emitting element, a reflector, a projection lens, and a movable shade are arranged in a lamp chamber. As the movable shade is erected, a low beam is formed. As the movable shade is tilted, a travelling beam is formed. The reflector and a sub reflector are integrally formed. The movable reflector reflects the reflected light reflected by the sub reflector toward the projection lens. The sub reflector is positioned in a range of an outer shape of the projection lens.

10 Claims, 15 Drawing Sheets

(51) Int. Cl.

| | |
|---|---|
| ***F21S 41/365*** | (2018.01) |
| ***F21S 41/675*** | (2018.01) |
| ***F21S 45/47*** | (2018.01) |
| ***F21S 45/00*** | (2018.01) |
| ***F21S 41/00*** | (2018.01) |
| ***F21S 43/00*** | (2018.01) |

(52) U.S. Cl.

CPC ..... *F21S 41/675* (2018.01); *F21S 43/00* (2018.01); *F21S 45/00* (2018.01); *F21S 45/47* (2018.01)

(56) References Cited

U.S. PATENT DOCUMENTS

| | | | | |
|---|---|---|---|---|
| 2007/0279927 | A1* | 12/2007 | Yamamichi ..... | F21S 41/147 362/545 |
| 2008/0112180 | A1* | 5/2008 | Okada ..... | F21S 41/155 362/518 |
| 2009/0310378 | A1 | 12/2009 | Tatara et al. | |
| 2010/0165654 | A1 | 7/2010 | Okubo et al. | |
| 2014/0029285 | A1* | 1/2014 | Bittinger ..... | F21S 41/192 362/511 |

FOREIGN PATENT DOCUMENTS

| | | | |
|---|---|---|---|
| JP | 2006-073305 | A | 3/2006 |
| JP | 2006-164688 | A | 6/2006 |
| JP | 2007-53057 | A | 3/2007 |
| JP | 2010-153333 | A | 7/2010 |
| JP | 2016-162709 | A | 9/2016 |

OTHER PUBLICATIONS

Written Opinion dated Nov. 21, 2017 by the International Searching Authority in counterpart International Patent Application No. PCT/JP2017/033535. (PCT/ISA/237).

Communication dated May 15, 2020, from the European Patent Office in counterpart European Application No. 17852991.3.

Communication dated Apr. 15, 2021, from The China National Intellectual Property Administration in Application No. 201780056132.8.

Zhicun Yici, "Fiber Reinforced Plastics Design Manual First Edition", China Building Industry Press, Mar. 31, 1986, p. 443 (3 pages total).

Zhou Xiangxing, "400 Cases of Common Questions on the Production Techniques of Plastic Packaging Products First Edition", China Light Industry Press, Apr. 30, 2002, p. 105 (3 pages total).

* cited by examiner

VEHICLE HEADLAMP

TECHNICAL FIELD

The disclosure relates to a vehicle headlamp.

BACKGROUND ART

In a vehicle headlamp, there is known a structure in which a light distribution of the headlamp is switched between a low beam and a travelling beam when a cutoff line forming shade disposed between a light convergence type reflector for reflecting light from a light source forward and a projection lens for light distribution formation is pivoted to erect/tilt. Further, for example, when the center luminosity of a travelling-beam light distribution is insufficient, an auxiliary reflector is provided in a lamp chamber to compensate the travelling-beam light distribution.

In this type of lamp, the size of the lamp can be reduced, as compared with a lamp structure in which two types of light source units having different specifications for a low beam and a travelling beam are accommodated in a lamp chamber. In particular, a high luminous flux corresponding LED (Light Emitting Diode) that can be used as a light source for a headlamp has been developed, and it becomes easier to make the lamp compact.

For example, in Patent Document 1 (see FIGS. 4 and 5 in Patent Document 1), a light source unit in which an LED as a light source, a light convergence type main reflector, and a projection lens for light distribution formation are integrated is accommodated in a lamp chamber. A paraboloid shaped auxiliary reflector for light distribution formation is integrated in front of the main reflector, and a movable shade for cutoff line formation, with which a light shielding member for shielding light emitted from the LED and directed to the auxiliary reflector is integrated, is disposed in the vicinity of a rear focus of the projection lens. Light emitted from the LED is reflected by the main reflector so as to condense on the rear focus of the projection lens in the longitudinal direction and is projected on the front of the lamp via the projection lens, thereby forming a predetermined light distribution of the headlamp.

Specifically, in a first mode (see FIG. 4) in which a movable shade is erected and a part of light reflected from the main reflector is shielded, a low-beam light distribution having a predetermined cutoff line corresponding to the front edge shape of the movable shade is formed. At this time, the light emitted from the LED and directed to the auxiliary reflector is shielded by the light shielding member, and the auxiliary reflector will not contribute to the formation of a low-beam light distribution.

Further, in a second mode (see FIG. 5) in which the movable shade is pivoted (tilted) and light reflected from the main reflector is not shielded, the light shielding member is also pivoted integrally with the movable shade, and the light emitted from the LED and directed to the auxiliary reflector is not shielded by the light shielding member. Therefore, a second light distribution reflected to the front of the lamp by the auxiliary reflector is combined with a first light distribution projected on the front of the lamp through the projection lens, thereby forming a travelling-beam light distribution with high center luminosity.

CITATION LIST

Patent Document

Patent Document 1: JP-A-2010-153333

DISCLOSURE OF INVENTION

Problems to be Solved by Invention

However, in Patent Document 1, it is necessary to arrange the auxiliary reflector so as to largely protrude outward from the projection lens so that the light reflected by the auxiliary reflector can be distributed forward from the outside of the projection lens. Therefore, an accommodation space in the lamp chamber of the light source unit is enlarged, which is contrary to the compactness of the lamp.

An object of the disclosure is to reduce the size of the vehicle headlamp capable of forming a travelling-beam light distribution.

Means for Solving the Problems

A vehicle headlamp according to a first aspect includes a lamp body having an opening portion;

a front cover for covering the opening portion;

a light emitting element disposed in a lamp chamber defined by the lamp body and the front cover and configured to emit light;

a reflector disposed in the lamp chamber and configured to condense and reflect a part of the light emitted from the light emitting element;

a sub reflector disposed in the lamp chamber, connected to the reflector, and configured to reflect a part of the light emitted from the light emitting element;

a projection lens disposed in the lamp chamber and configured to project the reflected light reflected by the reflector forward;

a movable shade disposed in the lamp chamber and disposed in the vicinity of a rear focus of the projection lens; and a movable reflector disposed in the lamp chamber, connected to the movable shade, and configured to reflect the reflected light reflected by the sub reflector toward the projection lens.

In a first mode in which the movable shade is erected, a low-beam light distribution having a cutoff line is formed.

In a second mode in which the movable shade is tilted, a travelling-beam light distribution not having the cutoff line is formed.

In the first mode, the movable reflector does not reflect the reflected light reflected by the sub reflector, whereas, in the second mode, the movable reflector is erected according to the tilting of the movable shade to reflect the reflected light reflected by the sub reflector toward the projection lens.

Further, the vehicle lamp may include a heat sink configured to mount the light emitting element and the reflector thereon.

The reflector may have a flange portion and a screw insertion hole formed in the flange portion.

The reflector may be fixed on the heat sink by a fastening screw inserted through the screw insertion hole.

The sub reflector may be formed integrally with the reflector.

A part of an inner peripheral surface of the screw insertion hole may be formed into a tapered shape inclined along the same direction as a demolding direction of the reflector.

Further, the vehicle lamp may include a pivot shaft extending in a right and left direction of the vehicle headlamp; and a spring member provided between the movable shade and the movable reflector.

The movable reflector may be disposed in front of the movable shade.

The movable shade and the movable reflector may be pivotable around the pivot shaft and urged and held in a direction of erecting together by the spring member.

When the movable shade is pivoted and shifted from the first mode to the second mode, the movable shade and the movable reflector may be pivoted integrally around the pivot shaft.

In the second mode, the movable reflector may be held by being locked by a first locking part so as to reflect the reflected light reflected by the sub reflector toward the projection lens, whereas the movable shade may be further pivoted to a predetermined position so as to be locked by a second locking part against an urging force of the spring member.

Further, the vehicle lamp may include a pivot shaft extending in a right and left direction of the vehicle headlamp; and a spring member provided between the movable shade and the movable reflector.

The movable reflector may be disposed in front of the movable shade.

The movable shade and the movable reflector may be pivotable around the pivot shaft and urged and held in a direction of erecting together by the spring member.

When the movable shade is pivoted and shifted from the first mode to the second mode, the movable shade and the movable reflector may be pivoted integrally around the pivot shaft.

In the second mode, the movable reflector may be held by being locked by a first locking part so as to reflect the reflected light reflected by the sub reflector toward the projection lens, whereas the movable shade may be further pivoted to a predetermined position corresponding to the maximum driving position of an actuator for driving the movable shade against an urging force of the spring member.

BRIEF DESCRIPTION OF DRAWINGS

FIG. 8A shows a low-beam light distribution pattern, and FIG. 8B shows a travelling-beam light distribution pattern;

FIG. 12A is a perspective view of the pair of protrusions when the die is opened, and FIG. 12B is a perspective view of the pair of protrusions when the die is closed;

FIG. 13A shows a mode (a first mode for low-beam formation) in which a movable shade is erected, and FIG. 13B shows a mode (a second mode for travelling-beam formation) in which the movable shade is tilted rearward;

FIG. 17A shows a first mode for low-beam formation, FIG. 17B shows a mode in which the movable reflector is locked with a locking member and stopped at a predetermined stop position when the movable shade and the movable reflector are integrally pivoted from the first mode and shifted to a second mode for travelling-beam formation, and FIG. 17C shows a second mode for travelling-beam formation, in which with the movable shade is further tilted rearward to a predetermined position respect to the movable reflector locked with the locking member and stopped at the predetermined stop position.

DESCRIPTION OF EMBODIMENTS

Next, embodiments of the disclosure will be described with reference to examples.

Figure 1:
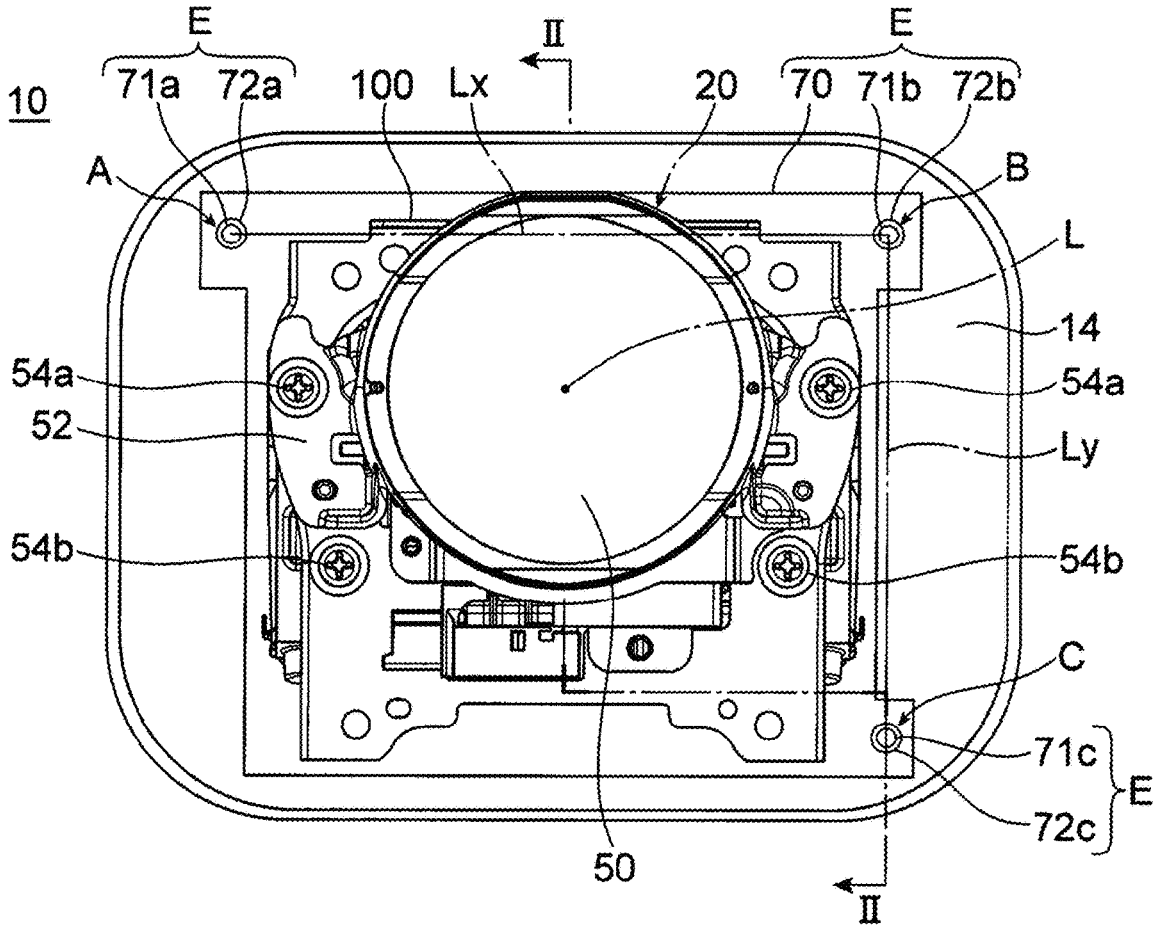
FIG. 1 is a front view of a vehicle headlamp according to a first embodiment of the disclosure.
Figure 2:
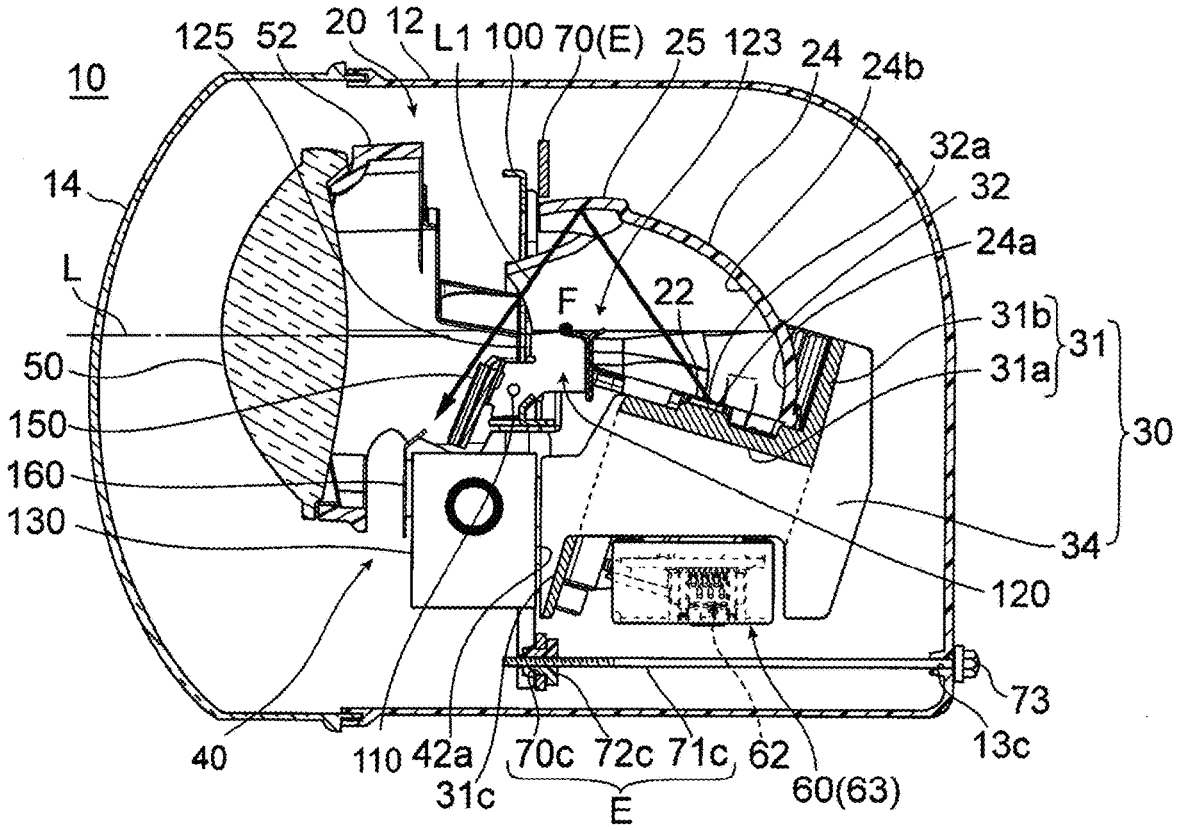
FIG. 2 is a longitudinal sectional view (a sectional view taken along the line II-II shown in FIG. 1) of the headlamp, showing a mode (a first mode for low-beam formation) in which a movable shade is erected.

In FIGS. 1 and 2, a vehicle headlamp 10 according to a first embodiment of the disclosure is configured so that a projection type light source unit 20 including a light emitting element (e.g. a high luminous flux corresponding LED) 22 as a light source is accommodated in a lamp chamber defined by a container-like lamp body 12 opened on the front side and a plain front cover (translucent cover) 14 attached to the front opening.

The light source unit 20 includes a heat sink 30 which is made of aluminum die cast and in which a large number of heat-dissipation fins 34 extend from a base plate 31 having an L-shaped longitudinal section. The light emitting element 22 as a light source and a resin reflector 24 for reflecting light emitted from the light emitting element 22 forward are attached on an upper surface of a horizontal base plate 31*a* of the base plate 31

Figure 3:
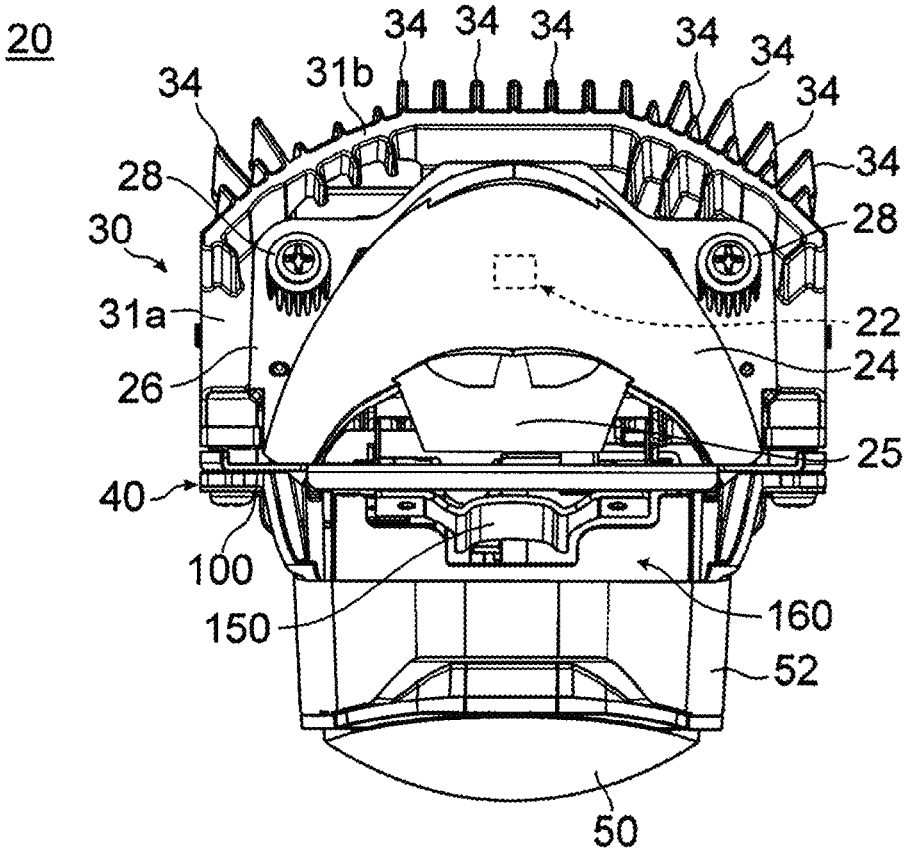
FIG. 3 is a plan view of a light source unit that is a main part of the headlamp.
Figure 4:
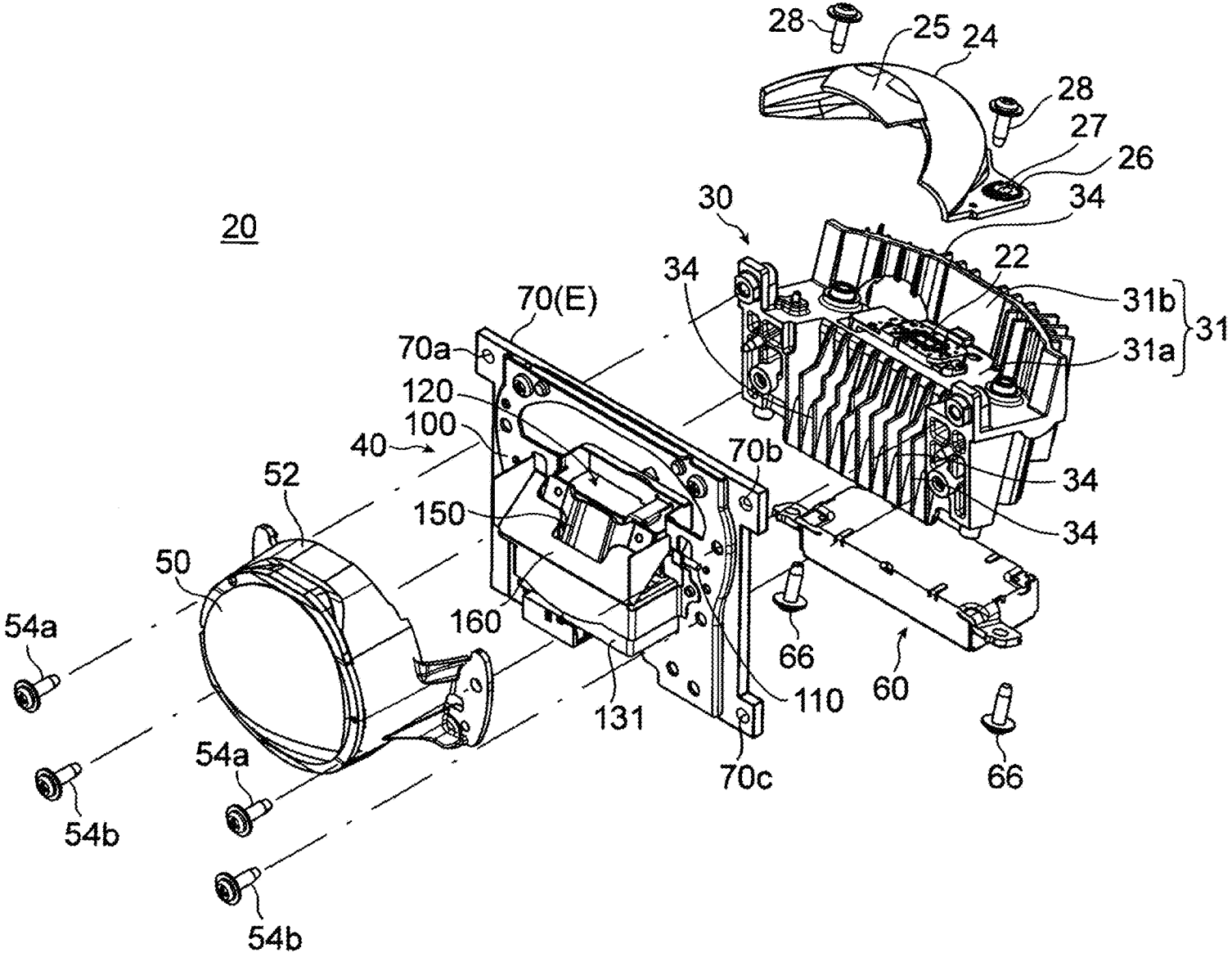
FIG. 4 is an exploded perspective view of the light source unit.

Specifically, in FIGS. 2, 3 and 4, a pedestal 32 adapted for mounting a light emitting element and having an element mounting surface 32*a* parallel to upper and lower surfaces of the horizontal base plate 31*a* is provided at the center of the upper surface of the horizontal base plate 31*a* constituting the heat sink 30. The light emitting element 22 is attached to the pedestal 32 with its irradiation axis directed upward. The reflector 24 attached to the rear of the upper surface of the horizontal base plate 31*a* is disposed to cover the upper side of the light emitting element 22. An effective reflecting surface 24*a* for the travelling beam is formed substantially on the lower half of the front surface of the reflector 24, and an effective reflecting surface 24*b* for the low beam is formed substantially on the upper half thereof. Further, a sub reflector 25 extending obliquely forward and downward is formed integrally on a front edge portion of the reflector 24. The reflector 24 is fixed to the horizontal base plate 31*a* by fastening screws 28 (see FIGS. 3 and 4) vertically penetrating screw insertion holes 27 provided in flange portions 26 of the reflector 24.

A vertical base plate 31*b* of the base plate 31 constituting the heat sink 30 is formed in a roughly R shape (see FIG. 3) in a plan view with the pedestal 32 as the center. On the back surface side of the vertical base plate 31*b*, the heat-dissipation fins 34 formed to extend rearward at equal intervals in the right and left direction extend in the upper and lower direction. Further, as shown in FIG. 2, the heat-dissipation fins 34 provided in the heat sink 30 extend from the back surface side of the vertical base plate 31*b* to the lower side of the horizontal base plate 31*a* and further to the front lower side of the horizontal base plate 31*a*. In this way, a large heat-dissipation area is secured and the heat-dissipation performance of the heat sink 30 is improved.

Further, a projection lens 50 made of resin is disposed in front of the heat sink 30, and a light distribution switching shade mechanism 40 including a movable shade 120 is disposed between the reflector 24 and the projection lens 50, thereby forming the integral light source unit 20.

Specifically, on the front surface side of the heat sink 30, a lens holder 52 for holding the projection lens 50 and a support plate 100 constituting the light distribution switching shade mechanism 40 and having a rectangular shape in a front view are fastened together and fixed by two fastening screws 54*a* (see FIGS. 1 and 4), and the projection lens 50 is disposed on an optical axis L of the light source unit 20. Meanwhile, a reference numeral 54*b* in FIGS. 1 and 4 refers to a fastening screw for fixing (the support plate 100 of) the light distribution switching shade mechanism 40 to the heat sink 30.

Further, as shown in FIGS. 2 and 4, a lighting circuit unit 60 for controlling the lighting of the light emitting element 22 is fixed to the lower surface side of the heat sink 30 by two screws 66. A lighting circuit 62 is configured by a circuit board on which electronic components (circuit elements) are mounted. The lighting circuit 62 is accommodated in a lighting circuit housing 63 and integrated as the lighting circuit unit 60 (see FIG. 2).

The movable shade 120 is pivoted (swung in the front and rear direction) around a pivot shaft 110 fixed to the support plate 100 by the driving of an electromagnetic solenoid 130 constituting the light distribution switching shade mechanism 40. In this way, the light distribution formed by the light source unit 20 is switched between a low beam (see FIG. 8A) with excellent visibility at a short distance and a travelling beam (see FIG. 8B) with excellent visibility at a long distance.

Hereinafter, the light distribution switching shade mechanism 40 will be described in detail.

Figure 5:
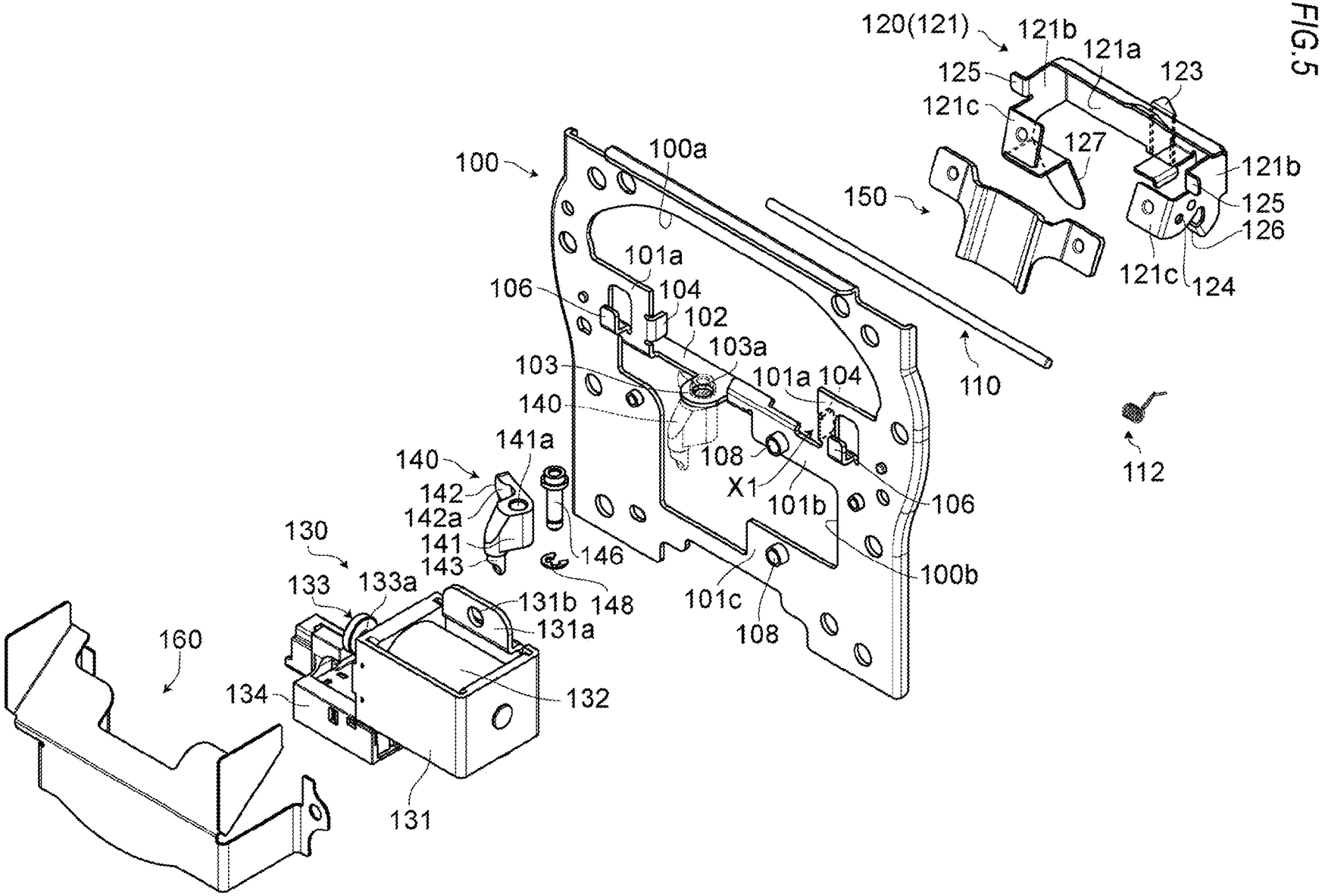
FIG. 5 is an exploded perspective view of a light distribution switching shade mechanism.

As shown in FIG. 5 which is an exploded perspective view of the light distribution switching shade mechanism 40, the light distribution switching shade mechanism 40 includes the support plate 100 having a rectangular frame shape, the pivot shaft 110 fixed to the front surface side of the support plate 100 and extending in the right and left direction, the movable shade 120 pivotably assembled to the pivot shaft 110, a torsion coil spring 112 interposed between the support plate 100 and the movable shade 120, the electromagnetic solenoid 130 fixed to the support plate 100 and serving as an actuator for driving the movable shade, a link member 140 interposed between the movable shade 120 and the electromagnetic solenoid 130 and serving as a power transmission means for converting the advancing and retracting motion of an output shaft 133 of the electromagnetic solenoid 130 into the pivot motion of the movable shade 120 and transmitting the converted power, a movable reflector 150 integrated with the movable shade 120, and a sub shade 160 fixed to the support plate 100 and disposed at a predetermined position in front of the movable reflector 150 (see FIGS. 4 and 5).

Figure 6:
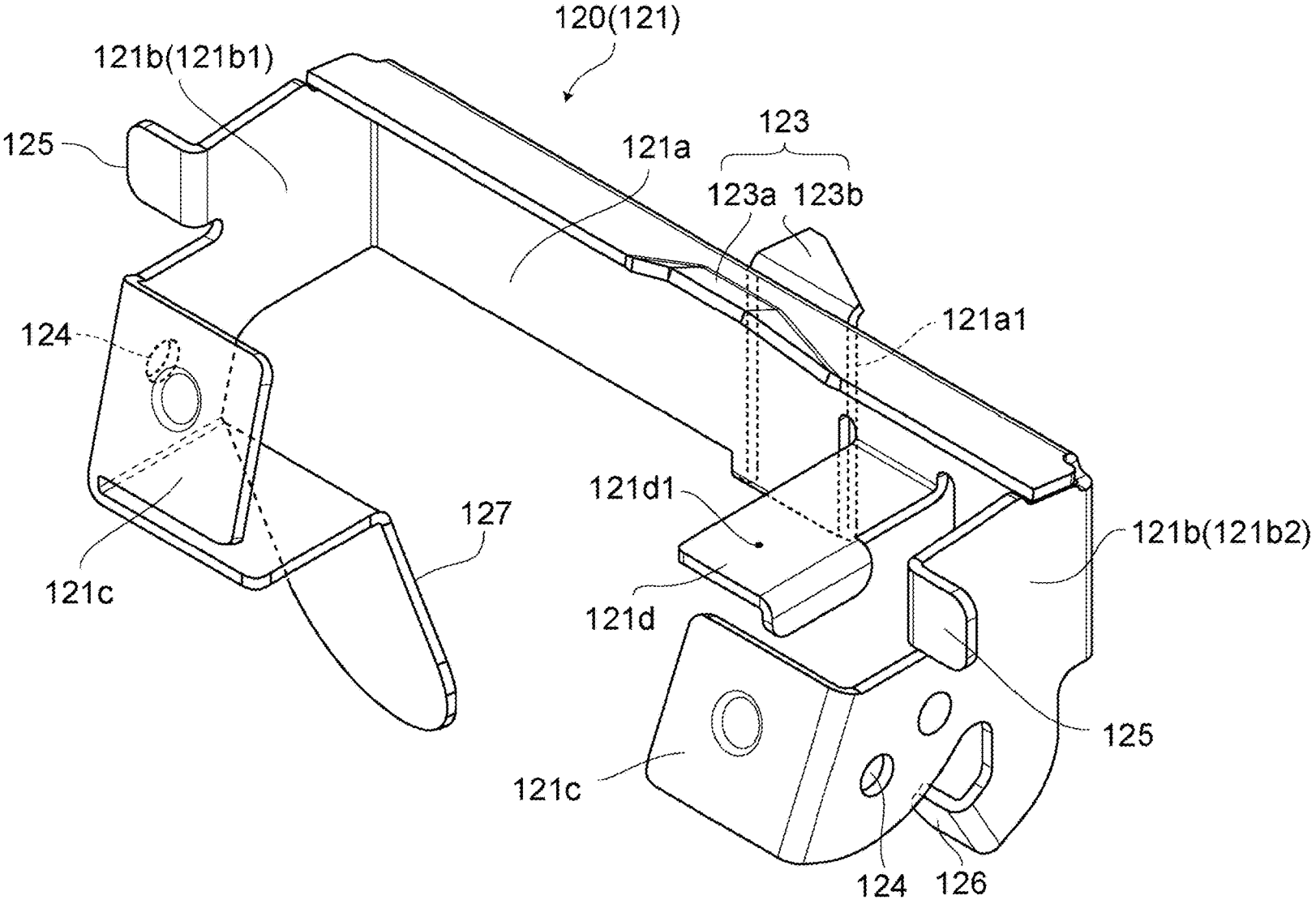
FIG. 6 is an enlarged perspective view of the movable shade.

By cutting a metal plate into a predetermined shape and then bending it, as shown in FIG. 6, the movable shade 120 is configured by a frame body 121 having a substantially rectangular shape in a plan view and opened on the front side. Specifically, side walls 121*b* (a left side wall 121*b*1 and a right side wall 121*b*2) extend forward from both end portions of a back surface wall 121*a* of the movable shade 120 extending to the right and left. Front end portions of the side walls 121*b* (the left side wall 121*b*1 and the right side wall 121*b*2) are bent inward in a width direction to form a pair of right and left rectangular reflector mounting portions 121*c*, 121*c*. The movable reflector 150 (see FIG. 5) is fixed to the reflector mounting portion 121*c*, so that the structural strength of the movable shade 120 is secured.

Further, a shade body 123 for forming a clear cutoff line is provided on an upper edge portion of the back surface wall 121*a*. The shade body 123 is configured by a front extending portion 123*a* and a rear extending portion 123*b*. However, in the present embodiment, as shown in FIG. 6, an extending portion 121*a*1 extending vertically downward in a band shape from a lower edge portion of the back surface wall 121*a* extending to the right and left is folded upward so as to be in close contact with the rear surface of the back surface wall 121*a*, and a leading end of the folded extending portion 121*a*1 is formed in a substantially triangular shape, thereby forming the rear extending portion 123*b*.

The rear extending portion 123*b* may be simply formed by cutting and raising a part of the back surface wall 121*a* (a region in the vicinity of the upper edge portion of the back surface wall 121*a*) upward in a triangular shape. However, in this case, it is necessary to take a measure (e.g., a measure for plugging the opening portion with a separate member) for preventing light leakage from a triangular opening portion (an opening portion corresponding to an outer shape of the movable shade body 123) appearing on the back surface wall 121*a*. By the way, in the present embodiment, such opening portion is formed in the back surface wall 121*a*, and thus, light leakage prevent measure is unnecessary. Accordingly, the structure of the movable shade 120 (the frame body 121) is simplified.

Further, a flat plate portion 121*d* extending horizontally forward is formed on the front surface side on the right side of the back surface wall 121*a*. A hole 121*d*1 for locking one end of the torsion coil spring 112 interposed between the support plate 100 and the movable shade 120 is provided in the flat plate portion 121*d*.

Further, circular holes 124 for inserting the pivot shaft 110 are provided to face each other on the front side of the side walls 121*b* (the left side wall 121*b*1 and the right side wall 121*b*2). A regulating projection 125 protruding outward (laterally) is provided at the upper portions of the side walls 121*b* (the left side wall 121*b*1 and the right side wall 121*b*2), respectively. Furthermore, a second regulating projection 126 protruding inward is provided at the lower end portion of the right side wall 121*b*2 close to the rear side.

The regulating projections 125 on the upper side are locking members for abutting against a rear surface of the support plate 100 and positioning the movable shade 120 in the first mode, and the second regulating projection 126 on the lower side is a locking member for abutting against a back surface of the support plate 100 and positioning the movable shade 120 in the second mode.

Further, a tongue-like protrusion 127 formed in a substantially L-shaped longitudinal section and extending downward from the rear side is provided at a position below the circular hole 124 inside the left side wall 121*b*1. The protrusion 127 is a member for cooperating with the link member 140 (to be described later) and converting the advancing and retracting motion of the output shaft 133 of the electromagnetic solenoid 130 into the pivot motion of the movable shade 120.

On the other hand, as shown in FIG. 5, in the support plate 100 to which the movable shade 120 is assembled, a light transmitting hole 100*a* and an arrangement hole 100*b* are formed to be spaced apart from each other in the upper and lower direction by a horizontal frame portion 102 which has a predetermined width and in which a mounting surface portion 103 protruding forward in an arc shape is provided. A circular hole 103*a* is provided in the arc-shaped mounting surface portion 103. A support shaft 146 for supporting the link member 140 (to be described later) is inserted through the circular hole 103*a* from above and protrudes below the mounting surface portion 103.

Further, a rectangular upright wall 101*a* is provided on the right and left side edge portions of the light transmitting hole 100*a* close to the horizontal frame portion 102 of the support plate 100, respectively. On the upright walls 101*a*, movable shade pressing pieces 104 protruding rearward are provided to be spaced apart from each other in the right and left direction. An L-shaped shaft mounting piece 106 protruding forward is provided at the position of the upright walls 101*a* outside the movable shade pressing pieces 104, respectively.

The pivot shaft 110 is inserted into the circular holes 124 provided in the side walls 121*b* of the movable shade 120. Both right and left end portions of the pivot shaft 110 are inserted into the shaft mounting pieces 106 of the support plate 100 from above. The shaft mounting pieces 106 are bent and crimped. In this way, the pivot shaft 110 is fixed to the front surface side of the support plate 100.

In a state where the pivot shaft 110 is fixed to the support plate 100, the movable shade 120 is inserted through the light transmitting hole 100*a* and disposed such that the movable shade body 123 is located on the rear side of the support plate 100, and the movable reflector 150 and the protrusion 127 are located on the front side of the support plate 100. At this time, the right and left side walls 121*b* of the movable shade 120 are held in a state of being in contact with the pair of right and left movable shade pressing pieces 104 on the side of the support plate 100, so that the movement in the right and left direction of the movable shade 120 with respect to the support plate 100 is regulated.

Further, as the pivot shaft 110 is fixed to the support plate 100, the movable shade 120 is pivotable with respect to the support plate 100 with the pivot shaft 110 as a pivot point. The movable shade 120 is pivoted between the first mode (see FIG. 2) in which the movable shade 120 is erected and the second mode (see FIG. 7) in which the movable shade 120 is tilted rearward (hereinafter, referred to as rearward tilting).

In the first mode in which the movable shade 120 is erected, the regulating projections 125 on the side of the movable shade 120 are held in a state of being urged and abutted against the rear surface of the upright wall 101*a* of the support plate 100. Therefore, the headlamp (the light source unit 20) forms a low-beam light distribution. On the other hand, in the second mode in which the movable shade 120 is tilted rearward, the reaulating projections 125 on the side of the movable shade 120 are spaced rearward from the support plate 100, and the second regulating projection 126 on the side of the movable shade 120 is held in a state of being urged and abutted against the rear surface of an upright wall 101*b* of the support plate 100. Therefore, the headlamp (the light source unit 20) forms a travelling-beam light distribution.

At the position indicated by a reference numeral X1 in FIG. 5, the torsion coil spring 112 is arranged externally fitted to the pivot shaft 110. One end of the spring 112 is engaged with (the hole 121*d*1 of the flat plate portion 121*d* of) the movable shade 12, and the other end thereof is engaged with the rear surface of the upright wall 101*b* of the support plate 100. Therefore, the torsion coil spring 112 interposed between the support plate 100 and the movable shade 120 causes the movable shade 120 to be urged in a direction pivoted from the second mode in which the movable shade body 123 is tilted rearward toward the first mode in which the movable shade body 123 is erected.

That is, the urging force of the spring 112 causes the movable shade 120 to be held in the first mode in which the regulating projections 125 are pressed against the rear surface of the upright wall 101*a* of the support plate 100.

Further, as the electromagnetic solenoid 130 is driven, the second regulating projection 126 is pressed against the rear surface of the upright wall 101*b* of the support plate 100 against the urging force of the spring 112, and the movable shade 120 is held in the second mode.

As shown in FIG. 5, the link member 140 has a base portion 141 and a flat plate-like sliding engagement portion 142 protruding laterally from the base portion 141. A connecting shaft portion 143 protruding downward is provided on the front end portion of the base portion 141, and a supported hole 141*a* penetrating in the upper and lower direction is formed in the rear end portion of the base portion 141.

The support shaft 146 protruding from the lower surface of the mounting surface portion 103 of the support plate 100 is inserted into the supported hole 141*a* of the link member 140, and a retaining ring 148 is attached to a lower end portion of the support shaft 146. In this manner, the link member 140 is pivotably supported on the support plate 100 with the support shaft 146 as a pivot point. In a state where the link member 140 is supported on the support plate 100, a part of the link member 140 is inserted through the arrangement hole 100*b* of the support plate 100, and the sliding engagement portion 142 is in contact with the rear surface side of the protrusion 127 of the movable shade 120.

The electromagnetic solenoid 130 functions as an actuator for pivoting the movable shade 120. As shown in FIG. 5, the electromagnetic solenoid 130 includes a laterally elongated yoke case 131 formed in a frame shape and penetrating in the front and rear direction, a coil body 132 disposed inside the yoke case 131, and the output shaft 133 movable in the right and left direction. The axial direction of the coil body 132 is the right and left direction. Drive current is supplied to the coil body 132 from a power supply circuit 134 provided adjacent to the lower side of the yoke case 131.

The axial direction of the output shaft 133 coincides with the right and left direction. A part of the output shaft 133 protrudes laterally from the yoke case 131. An annular connection groove 133*a* for engaging with the connecting shaft portion 143 of the link member 140 is formed at a portion near the leading end of the output shaft 133. The output shaft 133 moves in the axial direction according to the supply state of the drive current to the coil body 132.

The yoke case 131 is provided with brackets 131*a* respectively extending upward and downward. Positioning holes 131*b* are provided in the brackets 131*a*. Meanwhile, only the bracket 131*a* on the upper side is shown in FIG. 5.

On the other hand, on the front surface side of the upright wall 101*b* of the support plate 100 and an upright wall 101*c* below the upright wall 101*b*, positioning protrusions 108 engageable with the positioning holes 131*b* on the side of the yoke case 131 are provided. Further, the positioning holes 131*b* of the brackets 131*a* are engaged with the positioning protrusions 108, and the brackets 131*a* are fixed to the front surface of the support plate 100 by screwing or the like. In this manner, the electromagnetic solenoid 130 is disposed in the arrangement hole 100*b*.

The connecting shaft portion 143 of the link member 140 is connected to the electromagnetic solenoid 130 by being inserted into the connection groove 133*a* of the output shaft 133. Therefore, when the output shaft 133 moves in the axial direction according to the supply state of the drive current to the coil body 132, the link member 140 is pivoted with the support shaft 146 as a pivot point. Depending on the contact position of the protrusion 127 on the side of the movable shade 120 with the sliding engagement portion 142 of the link member 140, the movable shade 120 is pivoted in a direction tilted rearward with the pivot shaft 110 as a pivot point.

Further, the sub shade 160 is attached to the front surface side of the support plate 100 by screwing or the like so as to cover the electromagnetic solenoid 130. The sub shade 160 is foiuied by cutting and raising a metal plate such as a steel plate or an aluminum plate into a predetermined shape. The sub shade 160 is disposed in an upright wall shape between the projection lens 50 and the shade mechanism 40 in order not only to hide the coil body 132 of the electromagnetic solenoid 130, but also to prevent the light leakage from the front cover 14 or melt damage of resin products by sunlight incident through the projection lens 50.

In the headlamp 10 configured as described above, in a state where current is not supplied to the coil body 132 of the electromagnetic solenoid 130, the spring force (urging force) of the torsion coil spring 112 causes the movable shade 120 to be held in the first mode in which the regulating projections 125 are pressed against the rear surface of (the upright wall 101*a* of) the support plate 100 (see FIG. 2). At this time, the output shaft 133 of the electromagnetic solenoid 130 is positioned at a movement end in a direction protruding from the yoke case 131.

The link member 140 is positioned in a first pivot end at which the sliding engagement portion 142 is located on the rear side. The protrusion 127 of the movable shade 120 is in contact with a front surface side 142*a* (see FIG. 5) of the sliding engagement portion 142.

Figure 8A:
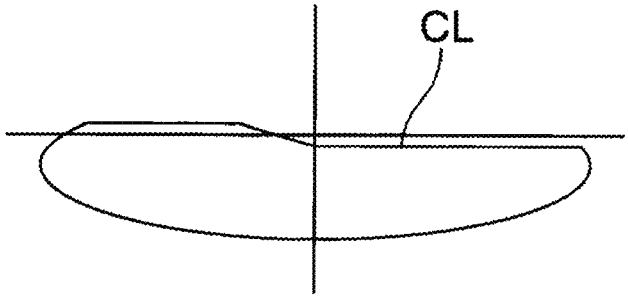
FIGS. 8A and FIG. 8B show a light distribution pattern of the headlamp.

In the first mode in which the movable shade 120 is erected, light emitted from the light emitting element 22 is reflected by the reflector 24 and directed to the projection lens 50. However, a part of the light is shielded by the movable shade 120, and the light which is not shielded is incident on the projection lens 50 and projected by the projection lens 50. In the first mode in which the movable shade 120 is erected, the movable shade body 123 is located at the position of a rear focus F of the projection lens 50, and a low-beam light distribution suitable for short distance irradiation is formed by the light source unit 20. That is, as shown in FIG. 8A, a low-beam light distribution having a predetermined cutoff line CL corresponding to the movable shade body 123 is formed.

Specifically, in the first mode in which the movable shade 120 is erected, a predetermined low-beam light distribution (see FIG. 8A) based on the reflected light of the reflector 24 and having the cutoff line CL corresponding to the movable shade body 123 is formed through the projection lens 50. At this time, as shown in FIG. 2, the movable reflector 150 integrated with the movable shade 120 is outside an optical path of a reflected light L1 by the sub reflector 25, and the reflected light by the sub reflector 25 is not guided to the projection lens 50 via the movable reflector 150. Therefore, the reflected light L1 by the sub reflector 25 does not affect the low-beam light distribution.

Further, when the coil body 132 of the electromagnetic solenoid 130 is energized, the output shaft 133 moves in a direction drawn into the yoke case 131, and the link member 140 is pivoted with the support shaft 146 as a pivot point. When the link member 140 is pivoted, the sliding engagement portion 142 of the link member 140 pushes the rear surface of the protrusion 127 of the movable shade 120 forward. Therefore, against the urging force of the torsion coil spring 112, the movable shade 120 is pivoted in a direction tilted rearward with the pivot shaft 110 as a pivot point (see FIG. 7).

In the second mode in which the movable shade 120 is tilted rearward, that is, when the movable shade 120 is pivoted to a position in which the second regulating projection 126 on the lower side of the movable shade 120 abuts against the rear surface of the support plate 100, the movable shade body 123 moves obliquely downward and rearward. Therefore, the light reflected by the reflector 24 is incident on the projection lens 50 without being shielded by the movable shade body 123. In this manner, a travelling beam suitable for long distance irradiation is formed.

Figure 7:
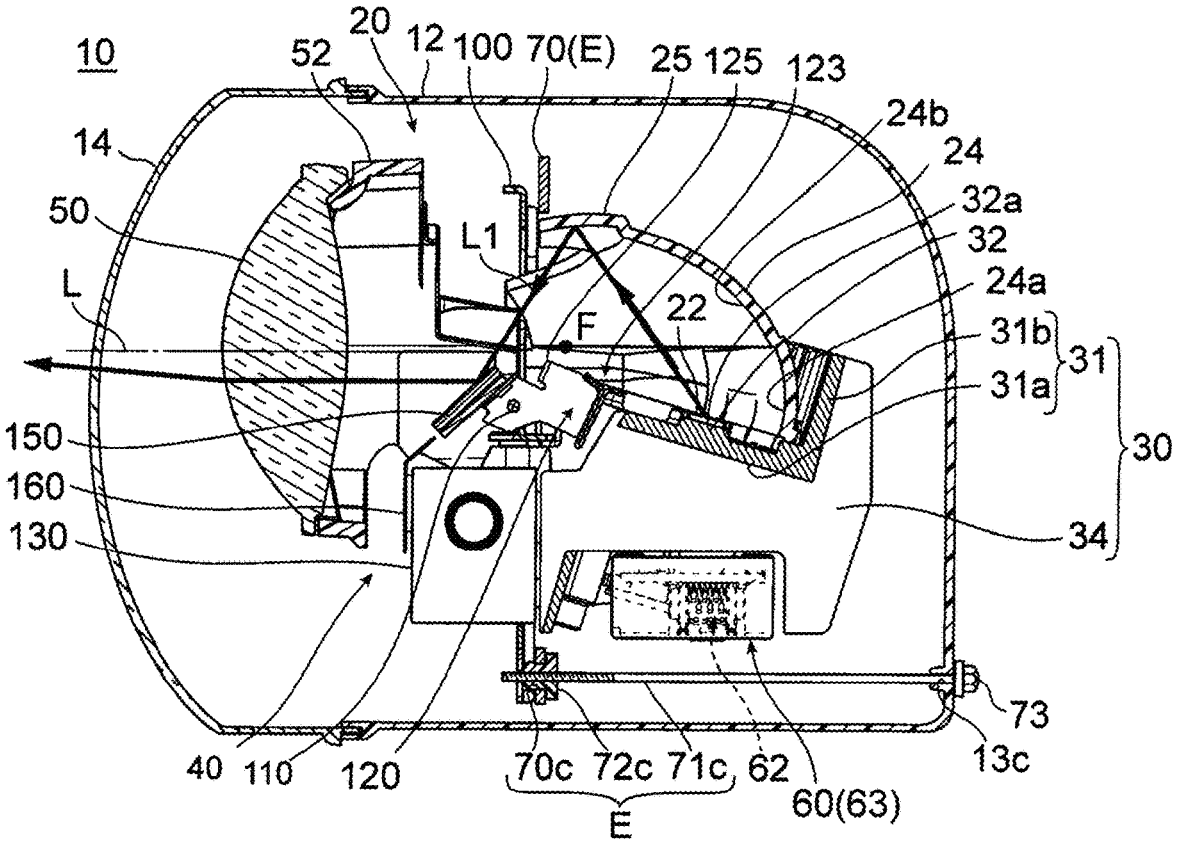
FIG. 7 is a longitudinal sectional view (a sectional view taken along the line II-II shown in FIG. 1) of the headlamp, showing a mode (a second mode for travelling-beam formation) in which the movable shade is tilted rearward.

That is, as shown in FIG. 7, in the second mode in which the movable shade 120 is tilted rearward, a first travelling-beam light distribution Pa (see FIG. 8B) based on the reflected light of the reflector 24 and having no cutoff line corresponding to the movable shade body 123 is formed through the projection lens 50. Further, when shifted from the first mode in which the movable shade 120 is erected to the second mode in which the movable shade 120 is tilted rearward, the movable reflector 150 is erected in association with the rearward tilting of the movable shade 120, protrudes on the optical path of the reflected light L1 by the sub reflector 25, and reflects the reflected light L1 toward the projection lens 50. Therefore, a second travelling-beam light distribution Pb (see FIG. 8B) based on the reflected light L1 of the sub reflector 25 and irradiating, for example, the vicinity of the optical axis L is formed through the projection lens 50.

Figure 8B:
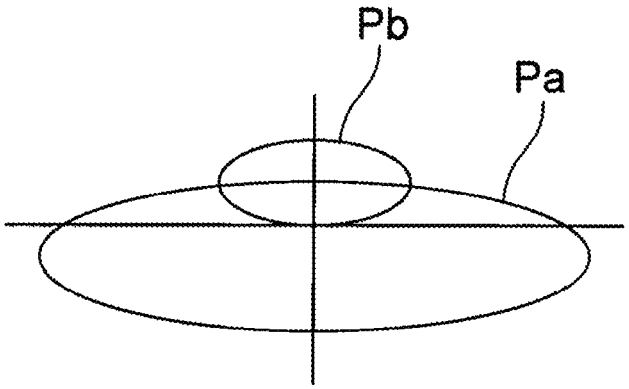

Therefore, in the second mode in which the movable shade 120 is tilted rearward, as shown in FIG. 8B, the first travelling-beam light distribution Pa based on the reflected light L1 of the reflector 24 and the second travelling-beam light distribution Pb based on the reflected light of the sub reflector 25 are combined, so that a predetermined travelling-beam light distribution with, for example, high central luminosity is formed.

Further, when the enemization to the coil body 132 is stopped, the spring force (urging force) of the torsion coil spring 112 causes the movable shade 120 to be pivoted from the second mode to the first mode with the pivot shaft 110 as a pivot point. In accordance with the pivoting of the movable shade 120, the link member 140 is pivoted, and the output shaft 133 of the electromagnetic solenoid 130 moves to a movement end in a direction protruding from the yoke case 131.

Meanwhile, in the present embodiment, the second travelling-beam light distribution Pb based on the reflected light L1 of the sub reflector 25 is formed through the projection lens 50. Therefore, the sub reflector 25 is positioned in a range of an outer shape of the projection lens 50 and does not protrude greatly outward form the projection lens 50, unlike the conventional paraboloid-shaped sub reflector (see Patent Document 1). In this manner, in the present embodiment, the light source unit 20 can be made compact, and accordingly, the headlamp 10 can be miniaturized, compared with Patent Document 1.

Further, as shown in FIGS. 1 and 2, the light source unit 20 accommodated in the lamp chamber is supported at three points including a pair of aiming points A, B spaced apart in the right and left direction on the upper side of the lamp chamber and one aiming point C located almost directly below the aiming point B. Further, with an aiming mechanism E, the light source unit 20 is supported tiltably around a horizontal tilting axis Lx passing through the aiming points A, B and a vertical tilting axis Ly passing through the aiming points B, C, respectively.

Specifically, as shown in FIGS. 1 and 2, a rectangular aiming bracket 70 in which holes 70*a*, 70*b*, 70*c* (holes 70*a*, 70*b* are not shown) corresponding to the aiming points A, B, C are provided and which is one size larger than the support plate 100 is integrally fixed to the support plate 100 of the light distribution switching shade mechanism 40 integrated as the light source unit 20. On the other hand, three aiming screws 71*a*, 71*b*, 71*c* provided with pivotal operation portions 73 are rotatably supported in through-holes 13*a*, 13*b*, 13*c* (through-holes 13*a*, 13*b* are not shown) provided in the back surface wall of the lamp body 12 and corresponding to the aiming points A, B, C and extend into the lamp chamber. Bearing nuts 72*a*, 72*b*, 72*c* respectively screwed to leading ends of the aiming screws 71*a*, 71*b*, 71*c* are mounted in the holes 70*a*, 70*b*, 70*c* of the bracket 70. That is, the optical axis L of the light source unit 20 can be tiltably adjusted in the right and left direction (the upper and lower direction) by pivoting the aiming screw 71*a* (71*c*) constituting the aiming mechanism E. Meanwhile, the aiming bracket 70 is not shown in FIG. 3.

Further, although the sub reflector 25 extending obliquely forward and downward is formed integrally with the front edge portion of the reflector 24, portions 27*a*, 27*b* of the upper and lower opening side inner peripheral surfaces of the screw insertion holes 27 provided in the flange portions 26 (see FIGS. 3, 4, 11A and 11B) of the reflector 24 are formed in a tapered shape inclined in the same direction as the demolding direction (direction indicated by the outline arrow in FIGS. 9 and 10) of the reflector 24. Therefore, without using split molds, the reflector 24 and the sub reflector 25 are integrally molded so that the screw insertion holes 27 of the flange portions 26 are not undercut.

Figure 9:
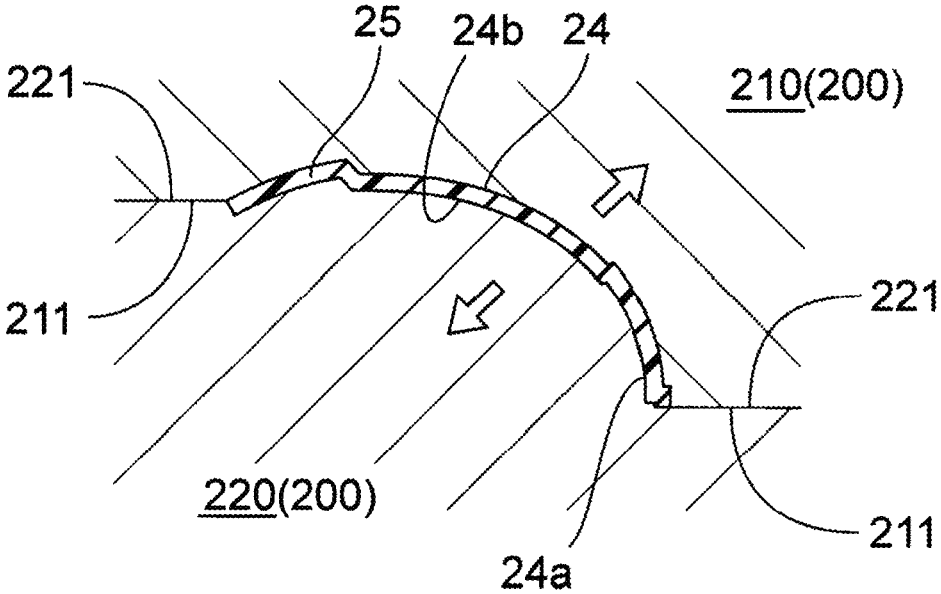
FIG. 9 is a longitudinal sectional view of a reflector molding die.
Figure 10:
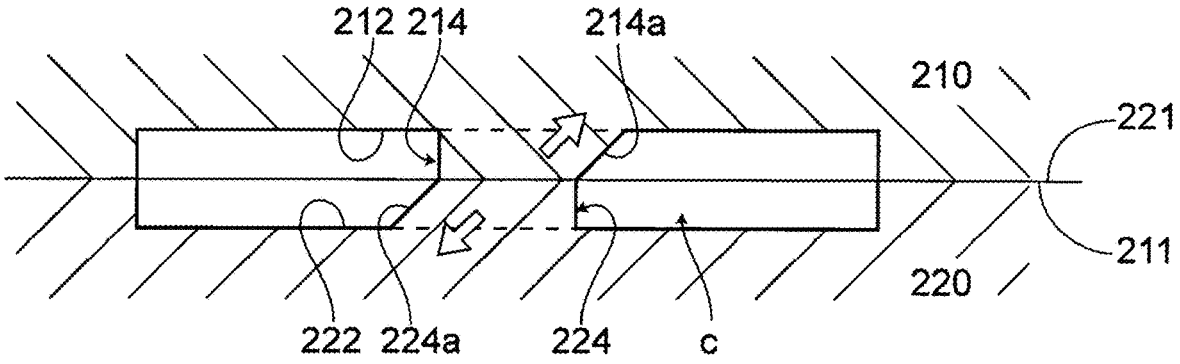
FIG. 10 is an enlarged longitudinal sectional view of a cavity for molding a flange portion of a reflector, which is formed in the reflector molding die.
Figure 11A:
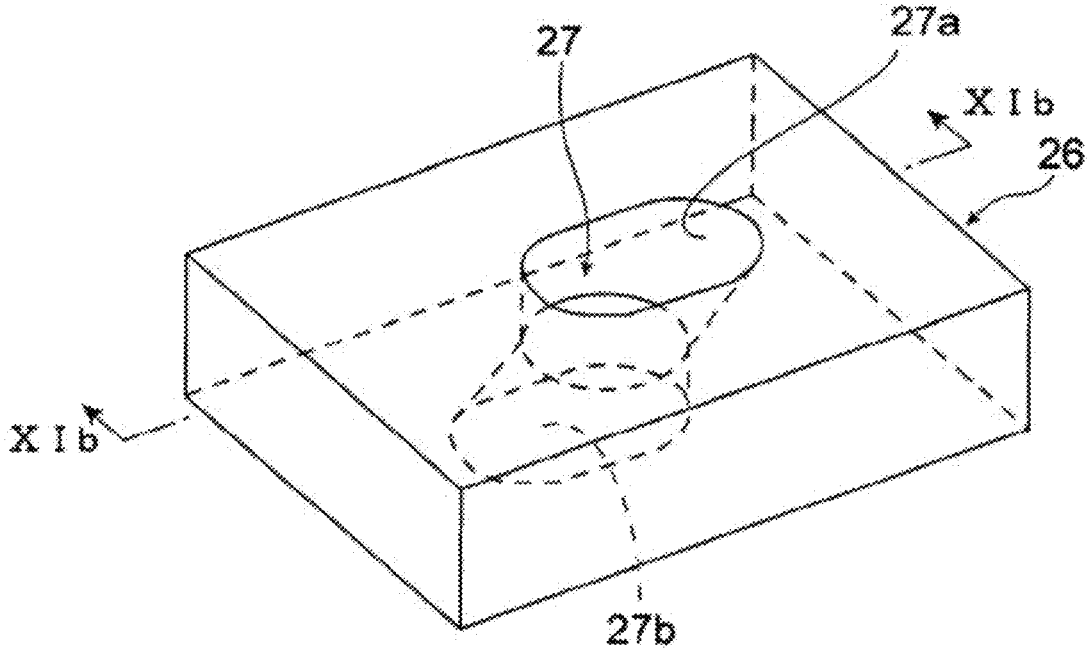
FIG. 11A is an enlarged perspective view of a fastening screw insertion hole provided in the flange portion of the reflector.
Figure 11B:
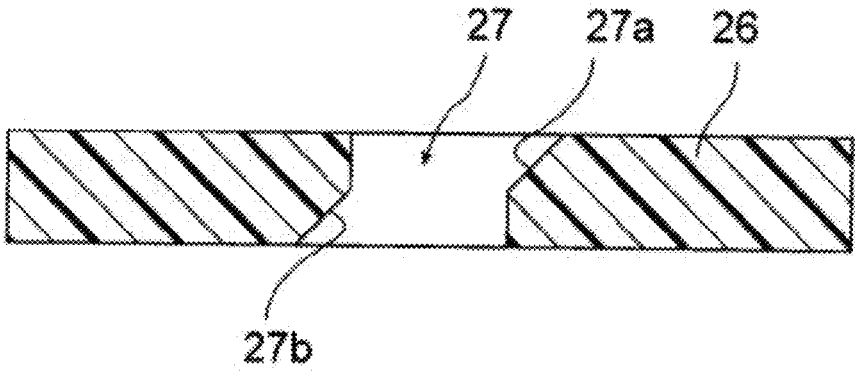
FIG. 11B is a longitudinal sectional view (a sectional view taken along the line XIb-XIb shown in FIG. 11A) of the fastening screw insertion hole provided in the flange portion of the reflector.
Figure 12A:
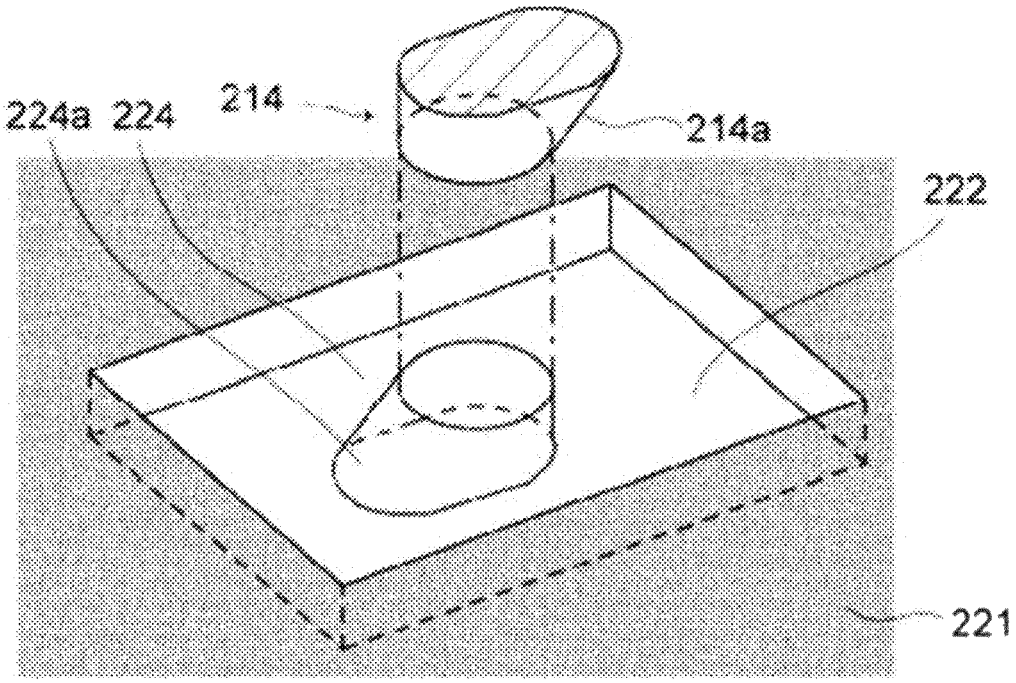
FIGS. 12A and FIG. 12B are enlarged perspective views of a pair of protrusions for molding the fastening screw insertion hole, which are provided to face each other on respective bottom surfaces of a pair of recessed portions defining the flange portion molding cavity formed along a division surface of the reflector molding die.
Figure 12B:
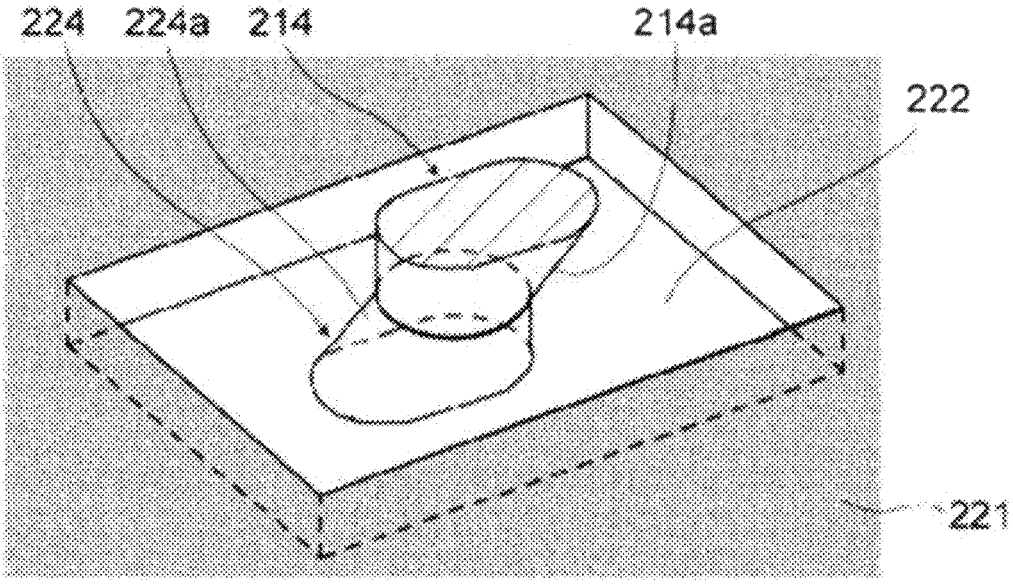
Figure 13A:
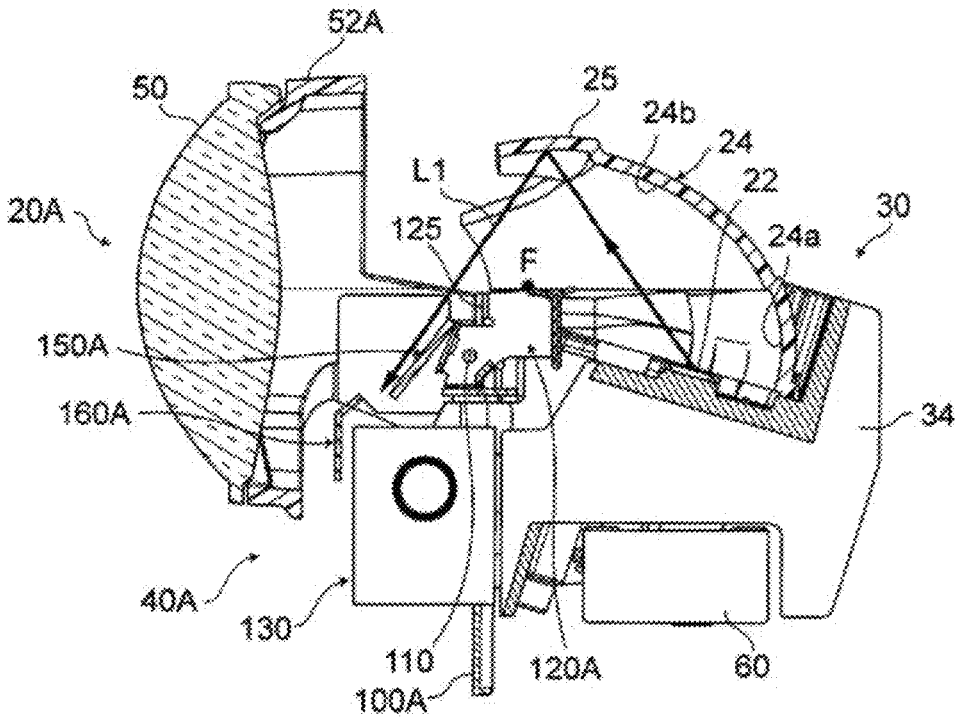
FIGS. 13A and FIG. 13B are longitudinal views of a light source unit that is a main part of a vehicle headlamp according to a second embodiment of the disclosure.
Figure 13B:
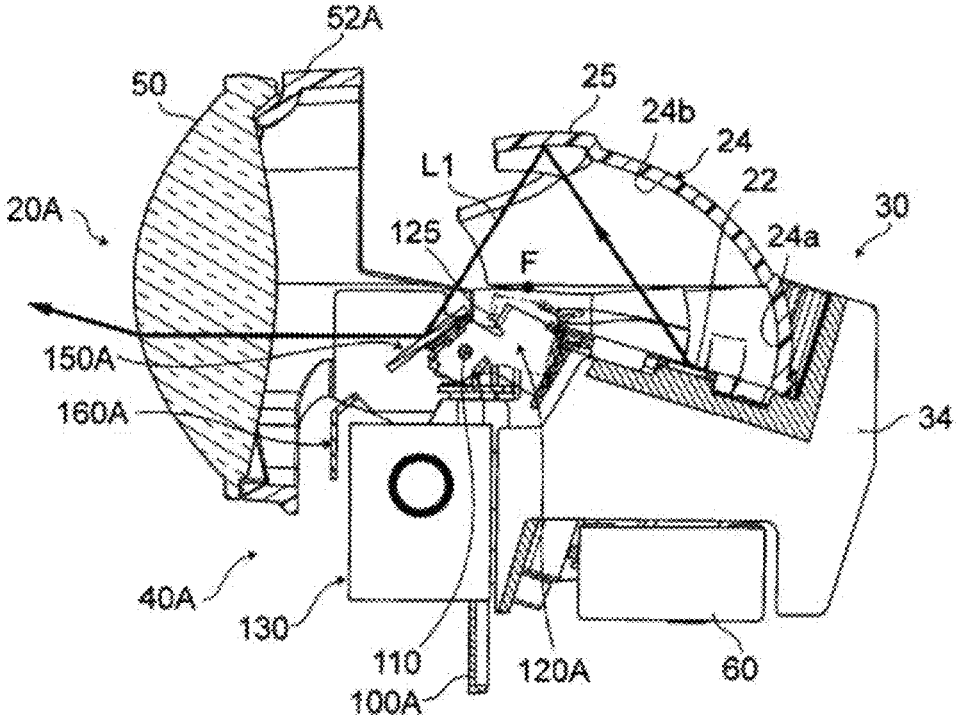

Specifically, an effective reflecting surface (an effective reflecting surface 24*a* capable of forming a light distribution upward from the optical axis of the projection lens 50, see FIGS. 2 and 9) corresponding to a travelling beam is formed on the lower side of the reflector 24. On the other hand, at the front edge portion of the reflector 24, the sub reflector 25 is formed to extend obliquely forward and downward. Therefore, when molding the sub reflector 25 integrally with the reflector 24, the effective reflecting surface 24*a* on the lower side of the reflector 24 is undercut when a molded product (see FIG. 9) is demolded in the upper and lower direction. On the other hand, the sub reflector 25 is undercut when a molded product is demolded in the front and rear direction.

Therefore, when a molded product is demolded in an extending direction of the sub reflector 25, neither the reflector 24 nor the sub reflector 25 are undercut, and the sub reflector 25 and the reflector 24 can be integrally molded. By the way, the screw insertion holes 27 for inserting the fastening screws 28 therethrough and fixing the reflector 24 on the base plate 31 of the heat sink 30 are provide in the flange portions 26 of the reflector 24. It is also necessary to mold these screw insertion holes 27 integrally with the reflector 24. However, since the extending direction of the screw insertion holes 27 (direction orthogonal to the extending direction of the flange portions 26) and the demolding direction (direction along the extending direction of the sub reflector 25) do not coincide, the screw insertion holes 27 are undercut.

By the way, in the present embodiment, as shown in FIG. 11, the portions 27*a*, 27*b* of the upper and lower opening side inner peripheral surfaces of the screw insertion holes 27 in the flange portions 26 of the reflector 24 are formed in a tapered shape inclined in the same direction as the demolding direction of the reflector 24. Therefore, when demolding the reflector 24 formed integrally with the sub reflector 25, the screw insertion holes 27 are not undercut.

Next, the shapes (see FIG. 11) of the screw insertion holes 27 of the flange portions 26 of the reflector 24 will be described with reference to FIGS. 9, 10, 12A and 12B showing a reflector molding die 200 (an upper die 210 and a lower die 220).

Recessed portions 212, 222 cooperating with each other to form a cavity c for molding the flange portions 26 of the reflector 24 are provided on division surfaces 211, 221 of the reflector molding die 200 (the upper die 210 and the lower die 220). The recessed portions 212, 222 face each other. On the respective bottom surfaces of the recessed portions 212, 222, cylindrical protrusions 214, 224 cooperating with each other to form an inner peripheral surface of the screw insertion hole 27 are provided to face each other. Outer surfaces 214*a*, 224*a* on a mold release direction (demolding direction) side in the pair of cylindrical protrusions 214, 224 facing each other are formed in a tapered shape inclined along the mold release direction (demolding direction). Therefore, when integrally molding the sub reflector 25 and the reflector 24, the screw insertion holes 27 provided in the flange portions 26 of the reflector 24 are not undercut.

Figure 15:
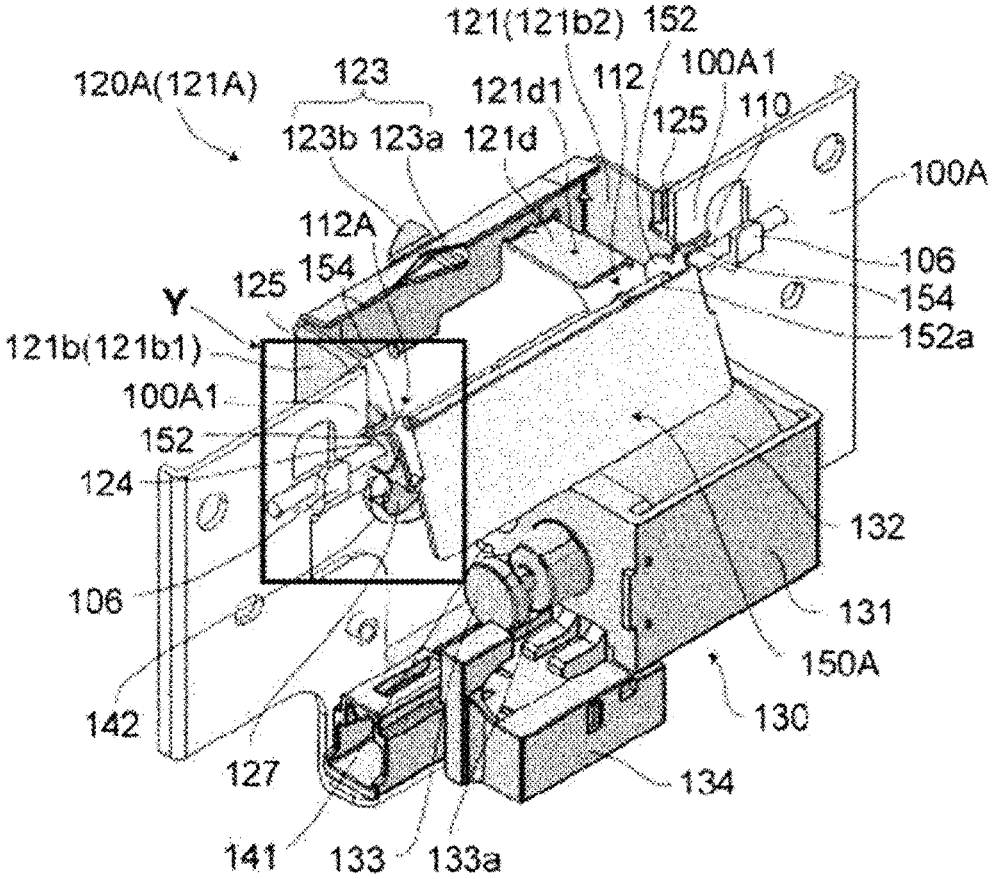
FIG. 15 is an enlarged front perspective view of a light distribution switching shade mechanism that is a main part of the headlamp.
Figure 16:
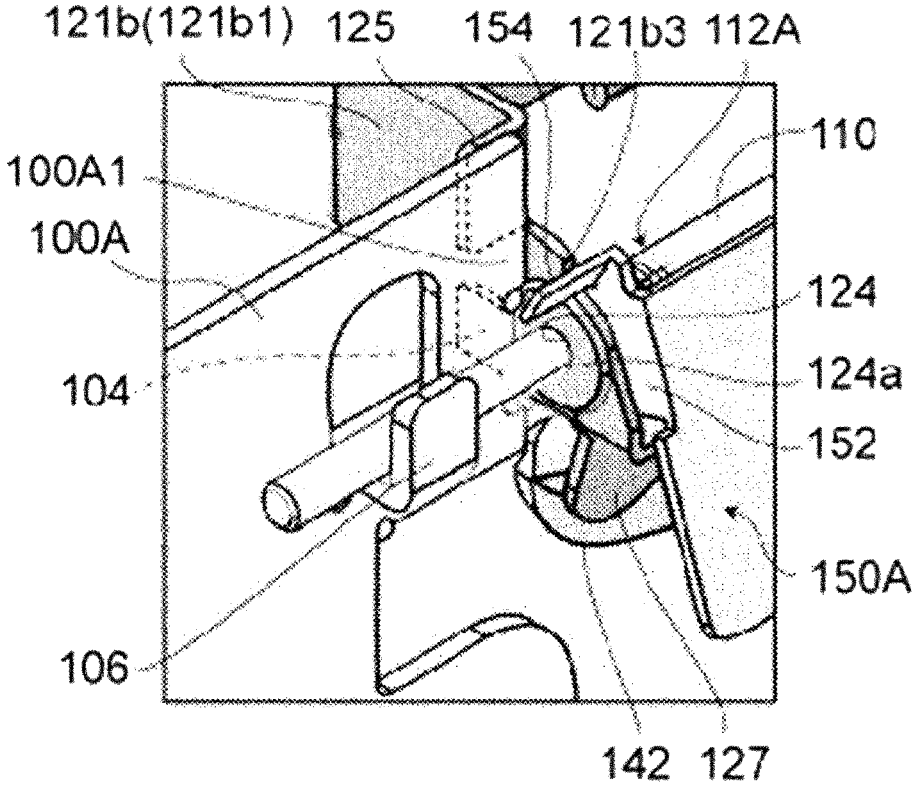
FIG. 16 is an enlarged perspective view showing an assembling structure (a portion surrounded by a rectangular frame Y in FIG. 15) between a movable shade and a movable reflector constituting the light distribution switching shade mechanism.
Figure 17A:
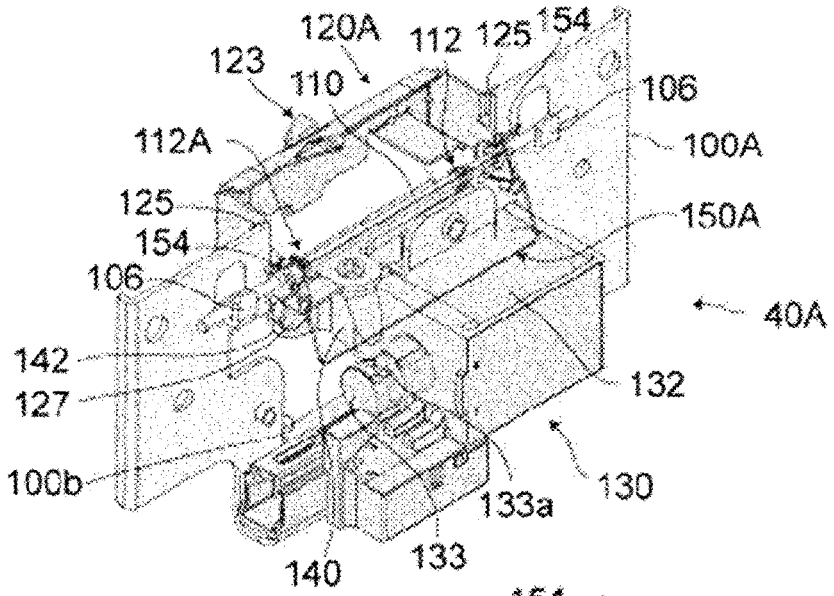
FIGS. 17A to FIG. 17C are perspective views of the light distribution switching shade mechanism.
Figure 17B:
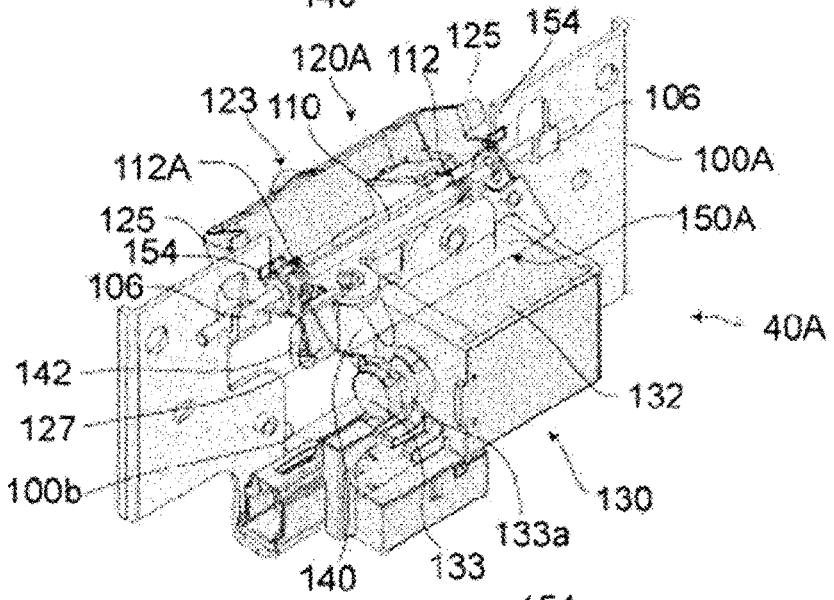
Figure 17C:
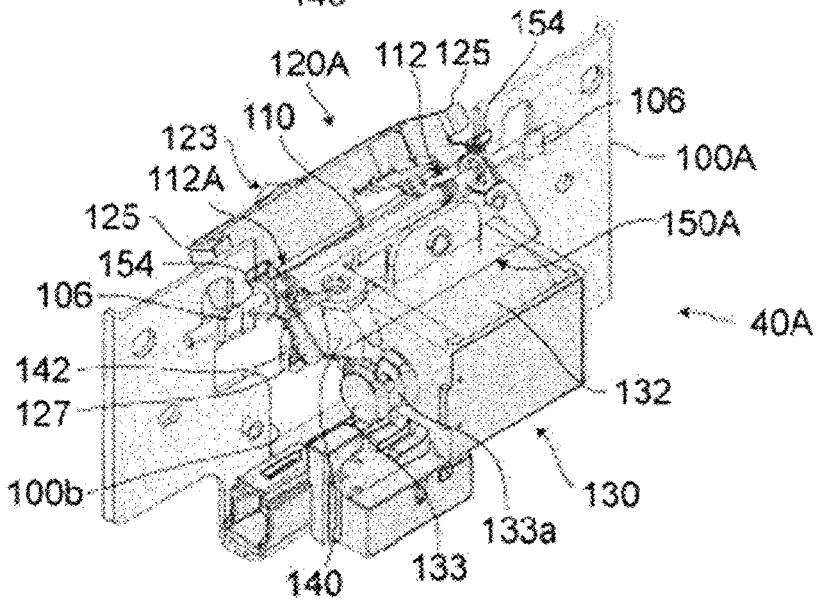

FIGS. 13A to 17C show a vehicle headlamp 10A according to a second embodiment of the disclosure. Meanwhile, FIGS. 17A, 17B and 17C are views for explaining an operation of a light distribution switching shade mechanism. Here, in order to make it easier to understand the movement of each component, a movable reflector is shown as being transparent.

In the second embodiment, three points, that is, the structure of a light distribution switching shade mechanism 40A, the shape and attachment position of a sub shade 160A, and the support structure of a light source unit 20A in a lamp chamber are largely different from those of the first embodiment. Since other configurations are the same as those of the first embodiment, the same components as those of the first embodiment are denoted by the same reference numerals, and duplicate explanations thereof are omitted.

Hereinafter, the differences will be described.

First, as the first difference, the structure of the light distribution switching shade mechanism 40A will be described.

In the light distribution switching shade mechanism 40 according to the first embodiment described above, the pivot shaft 110 is fixed to the support plate 100, the movable reflector 150 is fixed to the movable shade 120 pivotable around the pivot shaft 110, and the movable shade 120 and the movable reflector 150 are always integrally pivoted with respect to the support plate 100.

On the other hand, in the light distribution switching shade mechanism 40A of the present embodiment, the pivot shaft 110 is fixed to a support plate 100A (see FIG. 15) opened on the upper side, and a movable shade 120A and a movable reflector 150A are provided to be pivotable around the pivot shaft 110, respectively. A second torsion coil spring 112A is interposed between the movable shade 120A and the movable reflector 150A. The movable shade 120A and the movable reflector 150A are urged and held in a direction (in a direction approaching each other above the pivot shaft 110) in which they are erected together.

Therefore, when the movable shade 120A is shifted from the first mode in which it is erected to the second mode in which it is tilted rearward by the driving of the electromagnetic solenoid 130, the movable shade 120A and the movable reflector 150A are held at a predetermined angle and pivoted integrally around the pivot shaft 110 fixed to the support plate 100A. On the other hand, in the second mode, regulating projections 154 are locked to the front surface of the support plate 100A serving as a locking part, and the movable reflector 150A is held in an erected form protruding on the optical path of the reflected light L1 by the sub reflector 25. Further, against the urging force of the spring 112A, the movable shade 120A is further pivoted to a predetermined tilting position in which the second regulating projection 126 is locked to the rear surface of the support plate 100A serving as a second locking part.

Hereinafter, details will be described. As shown in FIG. 15, the movable shade 120A is formed in the same rectangular shape as the movable shade 120 of the first embodiment, but the rectangular reflector mounting portions 121*c*, 121*c* (see FIG. 6) for fixing the movable reflector 150A are not provided on the front surface portions of the right and left side walls 121*b* (the left side wall 121*b*1 and the right side wall 121*b*2).

Further, as shown in an enlarged view of FIG. 16, each of the right and left side walls 121*b* of the movable shade 120A has a front edge portion formed in a circular arc shape, and peripheral regions of the circular holes 124 through which the pivot shaft 110 is inserted are configured by circular bending stepped portions 124*a* bulging outward. Therefore, the rigidity strength of the side walls 121*b* is increased, and the contact area of the side walls 121*b* and the movable shade pressing pieces 104 on the side of the support plate 100A is reduced. In this way, the smooth pivoting of the movable shade 120A with respect to the support plate 100A is secured.

Further, stepped portions 121*b*3 for locking the movable reflector 150A pivotably assembled to the pivot shaft 110 are provided on the front edge portions of the right and left side walls 121*b*.

On the other hand, as shown in FIG. 15, the movable reflector 150A is formed in a rectangular flat plate shape elongated in the right and left direction, and tongue-like extending portions 152 extending rearward are formed on both right and left end portions of the movable reflector 150A. Circular holes 152*a* through which the pivot shaft 110 can be inserted are provided in the extending portions 152. The extending portions 152 are arranged to contact with the inner side of the right and left side walls 121*b* of the movable shade 120A, and the movable shade 120A and the movable reflector 150A can be relatively pivoted around the pivot shaft 110.

Further, the regulating projections 154 protruding outward (laterally) are provided on the extending portions 152 of the movable reflector 150A. The regulating projections 154 are provided at positions in which they can engage with the stepped portions 121*b*3 (see FIG. 16) on the front end portions of the side walls 121*b* of the movable shade 120A.

Further, the torsion coil spring 112A is interposed between the movable shade 120A and the movable reflector 150A, and the movable reflector 150A is urged to rotate in such a direction that the regulating projections 154 abut against the stepped portions 121*b*3 on the front end portions of the side walls 121*b*. Specifically, on the side opposite to the installation side of the torsion coil spring 112 interposed between the support plate 100A and the movable shade 120A, the torsion coil spring 112A is externally fitted to the pivot shaft 110. One end of the spring 112A is engaged with a predetermined position of the left side wall 121*b*1 of the movable shade 120A, and the other end thereof is engaged with a predetermined position of the movable reflector 150A.

Therefore, in a state where the electromagnetic solenoid 130 is not driven, that is, in a state where the coil body 132 of the electromagnetic solenoid 130 is not energized, as shown in FIGS. 15 and 16, the movable shade 120A and the movable reflector 150A are integrated into a state where the regulating projections 154 are urged and abutted against the stepped portions 121*b*3 on the front end portions of the side walls 121*b* by the torsion coil spring 112A interposed between the movable shade 120A and the movable reflector 150A.

Subsequently, the pivot movement of the movable shade 120A between the first mode and the second mode by the driving of the electromagnetic solenoid 130 will be described.

The movable shade 120A integrated with the movable reflector 150A so that the regulating projections 154 are urged and abutted against the stepped portions 121*b*3 on the front end portions of the side walls 121*b* is pivoted around the pivot shaft 110 by the driving of the electromagnetic solenoid 130 (the energization to the coil body 132) and shifted from the first mode (shown in FIGS. 15, 16, 17A and 13A) in which the movable shade 120A is erected and to the second mode (shown in FIGS. 17C and 13B) in which the movable shade 120A is tilted rearward. In particular, when shifted to the second mode, as shown in FIGS. 17B and 17C, the regulating projections 154 are locked to a front surface 100A1 of the support plate 100A and the movable reflector 150A is held in an erected form protruding on the optical path of the reflected light L1 by the sub reflector 25 (see FIG. 13B), whereas the movable shade 120A continues to pivot against the urging force of the spring 112A and is further pivoted to a predetermined tilting position (from the position indicated by the imaginary line to the position indicated by the solid line in FIG. 13B) in which the second regulating projection 126 provided on the movable shade 120A abuts against the rear surface of the support plate 100A serving as the second locking part (see FIG. 17C).

That is, after being shifted to the second mode, the movable reflector 150A is held in a state where the regulating projections 154 abut against the front surface of the support plate 100A by the urging force of the second spring 112A interposed between the movable shade 120A and the movable reflector 150A. On the other hand, the movable shade 120A continues to pivot against the urging force of the spring 112 interposed between the support plate 100A and the movable shade 120A and the urging force of the spring 112A interposed between the movable reflector 150A and the movable shade 120A and is held in a state where the second regulating projection 126 provided on the movable shade 120A abuts against the back surface of the support plate 100A serving as the second locking part.

Subsequently, as the second difference, the sub shade 160A will be described.

Figure 14:
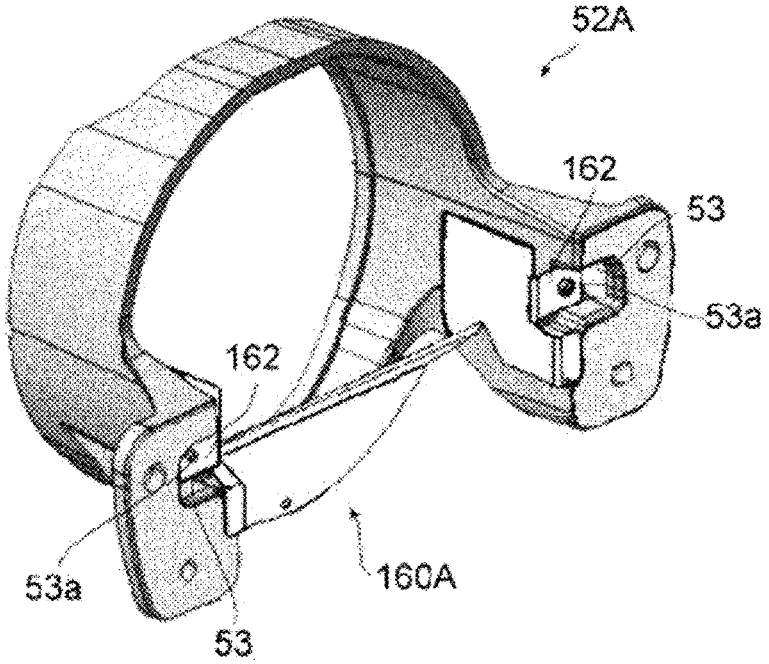
FIG. 14 is a rear perspective view of a lens holder that is a main part of the headlamp.

In the first embodiment described above, as shown in FIG. 5, the box-shaped sub shade 160 formed by cutting and raising a metal plate into a predetermined shape is attached to the front surface side of the support plate 100 of the light distribution switching shade mechanism 40 by screwing or the like. However, in the present embodiment, as shown in FIG. 14, the sub shade 160A of a simple shape molded by cutting and raising a metal plate into a predetermined shape has a structure in which bracket parts 162 on both ends thereof are engaged with engagement recessed portions 53 on the side of a resin lens holder 52A, and protruding portions 53*a* on the side of the engagement recessed portions 53 protruding from circular holes (not shown) provided in the bracket parts 162 are fixed by thermal caulking.

The sub shade 160 of the first embodiment is formed in a box shape having a width corresponding to the lateral width of the support plate 100 of the light distribution switching shade mechanism 40. On the contrary; the sub shade 160A of the present embodiment is configured in a compact and simple shape having a width corresponding to the lateral width of the lens holder 52A.

Meanwhile, the metallic sub shade 160A may be integrated with the resin lens holder 52A by insert molding. When the lens holder 52A is made of metal, the metallic sub shade 160A may be fixed and integrated to the lens holder 52A by welding or caulking.

As described above, in the present embodiment, the sub shade 160A having a compact and simple shape can be easily integrated with the lens holder 52. Therefore, the attachment of the sub shade 160A is facilitated, and the size of the light source unit 20 is reduced, which leads to the size reduction of the headlamp.

Subsequently, as the third difference, the light source unit 20A will be described.

In the first embodiment described above, the light source unit 20 is supported by the aiming mechanism E and (the optical axis L of) the light source unit 20 can be tiltably adjusted in the upper and lower direction and in the right and left direction. On the contrary, in the present embodiment, the light source unit 20A is supported by a swiveling mechanism (not shown) in a lamp chamber and (the optical axis L of) the light source unit 20A can be pivotally adjusted in the horizontal direction (the right and left direction) following a travelling direction of a vehicle (handle steering).

Meanwhile, in a lamp chamber, the light source unit 20A may be supported to be tiltable in the upper and lower direction with respect to the lamp body 12. When the light source unit 20A is supported to be tiltable in the upper and lower direction with respect to the lamp body 12, a leveling adjustment mechanism (not shown) is coupled to the lamp body 12. Furthermore, by the operation of the leveling adjustment mechanism, (the optical axis of) the light source unit 20A may be tilted in the upper and lower direction and the direction of the optical axis of the light source unit 20A may be adjusted in the upper and lower direction according to the weight of an on-board article (may be adjusted so that the inclination in the upper and lower of the optical axis with respect to the road surface is always constant).

Further, in the second embodiment described above, when the movable shade 120A is shifted from the first mode to the second mode by the driving of the electromagnetic solenoid 130, the movable shade 120A is pivoted to a predetermined position in which the second regulating projection 126 provided on the movable shade 120A is locked to the rear surface of the support plate 100 against the urging force of the torsion coil spring 112A. In a third embodiment (not shown) that is a modification of the second embodiment, the second regulating projection 126 is not provided on the movable shade 120A.

Therefore, in the third embodiment, when the movable shade 120A is shifted from the first mode to the second mode by the driving of the electromagnetic solenoid 130, the movable shade 120A is pivoted to a predetermined position corresponding to the maximum driving position of the electromagnetic solenoid 130 serving as an actuator against the urging force of the torsion coil spring 112A.

Therefore, the second mode (mode in which the movable shade 120A is tilted rearward and the movable reflector 150A is erected) corresponding the travelling beam in the second embodiment described above is a state in which the movable shade 120 is urged to rotate in a direction of being titled rearward by the driving force of the electromagnetic solenoid 130. That is, the driving force of the electromagnetic solenoid 130 acts as a compressed force on the contact portion between the second regulating projection 126 on the side of the movable shade 120A and the rear surface of the support plate 100A.

Specifically, the second regulating projection 126 on the side of the movable shade 120A abuts against the rear surface of the support plate 100A, and the movable shade 120A is positioned to the second mode (mode in which the movable shade 120A is tilted and the movable reflector 150A is erected) corresponding to the travelling beam. However, in order to prevent the contact portion between the second regulating projection 126 and the support plate 100A from being separated due to disturbance such as vibration during the travelling of a vehicle, the second regulating projection 126 on the side of the movable shade 120A and the rear surface of the support plate 100A are held in a contact state pressed by the driving force of the electromagnetic solenoid 130.

That is, the output shaft 133 of the electromagnetic solenoid 130 is in a state of being stopped at the middle of its operation range. This also applies to the first embodiment.

Therefore, firstly, the load on the driving part of the electromagnetic solenoid 130 is large, and there is a possibility that the electromagnetic solenoid 130 may fail or the durability thereof may be lowered.

Secondly, since a load acts in the vicinity of the contact portion between the second regulating projection 126 on the side of the movable shade 120A and the support plate 100A every time the light distribution of the headlamp is switched to the travelling beam, there is a possibility that the vicinity of the contact portion is deformed.

Thirdly, in order to increase the positioning accuracy of the second mode corresponding to the travelling beam, it is preferable to increase the compressive force (the driving force of the electromagnetic solenoid 130) acting on the contact portion between the second regulating projection 126 on the side of the movable shade 120A and the rear surface of the support plate 100A so as to reliably hold the second mode. However, the power consumption of the electromagnetic solenoid 130 increases accordingly.

In the third embodiment, when the movable shade 120A is pivoted and shifted from the first mode to the second mode by the driving of the electromagnetic solenoid 130, the movable shade 120A and the movable reflector 150A are pivoted integrally around the pivot shaft 110. On the other hand, in the second mode, the regulating projections 154 provided on the movable reflector 150A are locked to the front surface of the support plate 100A, and the movable reflector 150A is held in an erected form protruding on the optical path of the reflected light L1 by the sub reflector 25. Furthermore, against the urging force of the spring member 112A, the movable shade 120A is further pivoted to a predetermined position corresponding to the maximum driving position of the electromagnetic solenoid 130.

Therefore, unlike the first embodiment or the second embodiment, the output shaft 133 of the electromagnetic solenoid 130 serving as an actuator is not stopped at an intermediate state of its operating range, but is stopped at the maximum driving position of its operating range. Specifically, the output shaft 133 is stopped in a state of being in contact with a stopper inside the electromagnetic solenoid 130.

Therefore, the positioning accuracy of the tilted movable shade 120A in the second mode is somewhat lower than that of the movable shades 120, 120A in the first and second embodiments. On the other hand, in the third embodiment, the movable shade 120A is tilted to a position where the reflected light of the reflector 24 is not shielded. Therefore, even when the positioning accuracy of the movable shade 120A is somewhat reduced, it does not affect the formation of a first travelling-beam light distribution P1.

Furthermore, the movable reflector 150A is held in an erected form in which the regulating projections 154 of the movable reflector 150A are urged and abutted against the front surface of the support plate 100 by the spring 112A interposed between the movable shade 120A and the movable reflector 150A. Therefore, the positioning accuracy of the movable reflector 150A is high and does not affect the formation of a second travelling-beam light distribution P2 based on the reflected light of the sub reflector 25.

Meanwhile, in the above embodiments, both the spring members interposed between the support plates 100, 100A and the movable shades 120, 120A and the spring member interposed between the movable shade 120A and the movable reflector 150A are the torsion coil springs 112, 112A. However, the spring members may be spring members such as leaf springs.

Further, in the above embodiments, the actuator for pivoting the movable shade is configured by an electromagnetic solenoid. However, the actuator may be a driving source such as a motor.

Further, in the above embodiments, the link member is provided between the electromagnetic solenoid and the movable shade in order to convert the linear motion of the output shaft of the electromagnetic solenoid to the rotational motion of the movable shade. However, instead of the link member, other mechanisms such as a rack and pinion may be used.

This application appropriately incorporates the contents disclosed in Japanese Patent Application (Japanese Patent Application No. 2016-184100) filed on Sep. 21, 2016.

The invention claimed is:

1. A vehicle headlamp comprising:

a lamp body having an opening portion;

a front cover for covering the opening portion;

a light emitting element disposed in a lamp chamber defined by the lamp body and the front cover and configured to emit light;

a reflector disposed in the lamp chamber and configured to condense and reflect a part of the light emitted from the light emitting element;

a sub reflector disposed in the lamp chamber, directly connected to the reflector, and configured to reflect a part of the light emitted from the light emitting element;

a projection lens disposed in the lamp chamber and configured to project the reflected light reflected by the reflector forward;

a movable shade disposed in the lamp chamber and disposed in the vicinity of a rear focus of the projection lens;

a movable reflector disposed in the lamp chamber, connected to the movable shade, and configured to reflect the reflected light reflected by the sub reflector toward the projection lens; and a pivot shaft extending in a right and left direction of the vehicle headlamp, wherein, in a first mode in which the movable shade is erected, a low-beam light distribution having a cutoff line is formed, wherein, in a second mode in which the movable shade is tilted, a travelling-beam light distribution not having the cutoff line is formed, wherein the movable reflector is disposed in front of the movable shade, wherein, in the first mode, the movable reflector does not reflect the reflected light reflected by the sub reflector, whereas, in the second mode, the movable reflector is erected according to the tilting of the movable shade to reflect the reflected light reflected by the sub reflector toward the projection lens, wherein when the movable shade is pivoted and shift from the first mode to the second mode, the movable shade and the movable reflector are pivoted integrally around the pivot shaft, and wherein, in the first mode, a reflecting surface of the movable reflector is opposed to an incident surface of the projection lens.

2. The vehicle headlamp according to claim 1, further comprising a heat sink configured to mount the light emitting element and the reflector thereon, wherein the reflector has a flange portion and a screw insertion hole formed in the flange portion, wherein the reflector is fixed on the heat sink by a fastening screw inserted through the screw insertion hole, wherein the sub reflector is formed integrally with the reflector, and wherein a part of an inner peripheral surface of the screw insertion hole is formed into a tapered shape inclined along the same direction as a demolding direction of the reflector.

3. The vehicle headlamp according to claim 1, further comprising:

a spring member provided between the movable shade and the movable reflector, wherein the movable shade and the movable reflector are pivotable around the pivot shaft and urged and held in a direction of erecting together by the spring member, and wherein, in the second mode, the movable reflector is held by being locked by a first locking part so as to reflect the reflected light reflected by the sub reflector toward the projection lens, whereas the movable shade is further pivoted to a predetermined position so as to be locked by a second locking part against an urging force of the spring member.

4. The vehicle headlamp according to claim 1, further comprising a pivot shaft extending in a right and left direction of the vehicle headlamp; and a spring member provided between the movable shade and the movable reflector, wherein the movable reflector is disposed in front of the movable shade, wherein the movable shade and the movable reflector are pivotable around the pivot shaft and urged and held in a direction of erecting together by the spring member, wherein when the movable shade is pivoted and shifted from the first mode to the second mode, the movable shade and the movable reflector are pivoted integrally around the pivot shaft, and wherein, in the second mode, the movable reflector is held by being locked by a first locking part so as to reflect the reflected light reflected by the sub reflector toward the projection lens, whereas the movable shade is further pivoted to a predetermined position corresponding to the maximum driving position of an actuator for driving the movable shade against an urging force of the spring member.

5. The vehicle headlamp according to claim 1, wherein no light originating from the light emitting element reflects off the movable reflector when the movable shade is in the first mode.

6. The vehicle headlamp according to claim 1, wherein the travelling-beam light distribution and the low-beam light distribution originate from the same light emitting element.

7. The vehicle headlamp according to claim 1, wherein the light emitting element is a high luminous flux light emitting diode.

8. The vehicle headlamp according to claim 1, wherein a surface plane of the movable reflector intersects an optical axis of the vehicle headlamp at a non-perpendicular angle in both the first and second modes.

9. The vehicle headlamp according to claim 1, wherein the lamp chamber contains only one light emitting element.

10. The vehicle headlamp according to claim 1, wherein the movable reflector is located in front of the pivot shaft and the movable shade is located behind the pivot shaft along an optical axis of the vehicle headlamp.

* * * * *